US012410554B2

(12) United States Patent
Li et al.

(10) Patent No.: US 12,410,554 B2
(45) Date of Patent: Sep. 9, 2025

(54) SYSTEM AND METHOD OF ACCELERATING POLYMER FIBER STABILIZATION VIA IRRADIATION TREATMENT

(71) Applicant: University of Virginia Patent Foundation, Charlottesville, VA (US)

(72) Inventors: Xiaodong Li, Charlottesville, VA (US); Zan Gao, Willimantic, CT (US); Jiadeng Zhu, Charlottesville, VA (US); Yellapu V. Murty, Charlottesville, VA (US); Kenneth Brown, Charlottesville, VA (US); Clifton Bumgardner, Charlottesville, VA (US)

(73) Assignee: University of Virginia Patent Foundation, Charlottesville, VA (US)

( * ) Notice: Subject to any disclaimer, the term of this patent is extended or adjusted under 35 U.S.C. 154(b) by 677 days.

(21) Appl. No.: 17/617,192

(22) PCT Filed: Jun. 10, 2020

(86) PCT No.: PCT/US2020/037010

§ 371 (c)(1),
(2) Date: Dec. 7, 2021

(87) PCT Pub. No.: WO2020/252031

PCT Pub. Date: Dec. 17, 2020

(65) Prior Publication Data

US 2022/0235516 A1 Jul. 28, 2022

Related U.S. Application Data

(60) Provisional application No. 62/859,746, filed on Jun. 11, 2019.

(51) Int. Cl.
*D06M 10/00* (2006.01)
*D01F 9/22* (2006.01)

(52) U.S. Cl.
CPC ..... *D06M 10/001* (2013.01); *D01F 9/22* (2013.01); *D10B 2101/12* (2013.01)

(58) Field of Classification Search
CPC .... D06M 10/001; D06M 11/13; D06M 11/28; D06M 2101/34; D06M 10/003;
(Continued)

(56) References Cited

U.S. PATENT DOCUMENTS 4,197,282 A * 4/1980 Bailly-Lacresse ..... D01F 9/145 423/447.6
5,160,464 A 11/1992 Ward et al.
(Continued)

FOREIGN PATENT DOCUMENTS

KR 1020110115332 A 10/2011
KR 101327972 B1 11/2013
(Continued)

OTHER PUBLICATIONS

Zhang, et al., Carbon Fibers from UV-Assisted Stabilization of Lignin-Based Precursors, Fibers 2015; 3: 184-196 (Year: 2015).*
(Continued)

*Primary Examiner* — Daniel C. McCracken
(74) *Attorney, Agent, or Firm* — Robert J. Decker

(57) ABSTRACT

A new technique for treating non-PAN-based pre-cursor polymeric fibers, tows, yarns, and films has been created for use in making stabilized pre-cursor polymers. By applying stepwise or non-stepwise microwave and/or ultraviolet radiation to the pre-cursor polymeric fibers, tows, yarn, or films prior to the stabilization thereof, a reduction in time for the costly stabilization process is achieved. Application of this technique extends to less-costly production of carbon fibers, for uses in industries such as automotive, aviation, trains, medical, military, sporting goods, orthopedics, and other industries. The pre-cursor polymeric fibers, tows,
(Continued)

yarns, or films may be a multi-component polymer composite comprised of a non-PAN-based polymeric fiber, tow, yarn, or film and at least one or more constituent materials. Carbonization of such pre-cursor polymeric fibers, tows, yarns, or films results in less-costly carbon fibers that perform equally, if not better, than traditional costly PAN-based carbon fibers.

36 Claims, 8 Drawing Sheets

(58) Field of Classification Search
CPC ..... D01F 9/22; D01F 9/14; D01F 1/10; D01F 9/00; D01F 9/08; D01F 9/12; D01F 9/32; D01F 9/324; D01F 9/326; D01F 9/328; D01F 11/00; D01F 11/02; D01F 11/04; D01F 11/06; D01F 11/08; D01F 11/10; D01F 11/12; D01F 11/121; D01F 11/122; D01F 11/123; D01F 11/124; D01F 11/125; D01F 11/126; D01F 11/127; D01F 11/128; D01F 11/129; D01F 11/14; D01F 11/16; D10B 2101/12
See application file for complete search history.

(56) References Cited

U.S. PATENT DOCUMENTS

| | | | | |
|---|---|---|---|---|
| 7,381,752 | B2 | 6/2008 | Muratoglu | |
| 7,527,656 | B2 | 5/2009 | Griffin et al. | |
| 7,649,078 | B1 | 1/2010 | Paulauskas et al. | |
| 7,786,253 | B2 | 8/2010 | Paulauskas et al. | |
| 8,012,573 | B2 | 9/2011 | Kowata et al. | |
| 8,685,361 | B2 | 4/2014 | Yang et al. | |
| 9,371,423 | B2 | 6/2016 | Davis et al. | |
| 9,828,700 | B2 | 11/2017 | Naskar et al. | |
| 10,344,404 | B2 | 7/2019 | Jo et al. | |
| 10,446,329 | B2 | 10/2019 | Li et al. | |
| 2006/0183834 | A1 | 8/2006 | Kuwahara et al. | |
| 2009/0263295 | A1* | 10/2009 | Paulauskas | D01F 9/225 422/186.21 |
| 2012/0021249 | A1 | 1/2012 | Shin et al. | |
| 2013/0084455 | A1 | 4/2013 | Naskar et al. | |
| 2017/0084924 | A1 | 3/2017 | Li et al. | |
| 2018/0244582 | A1 | 8/2018 | Li et al. | |

FOREIGN PATENT DOCUMENTS

| | | | |
|---|---|---|---|
| WO | 2017031403 | A1 | 2/2017 |
| WO | 2019071286 | A1 | 4/2019 |

OTHER PUBLICATIONS

Kleinhans, et al., Development of lignin carbon fibers: Evaluation of the carbonization process, J. Appl. Polym. Sci. 2016; 43965, pp. 1-7 (Year: 2016).*
Liu, et al., Study on the oxidative stabilization of polyacrylonitrile fibers by microwave heating, Polymer Degradation and Stability 2018; 150: 86-91 (Year: 2018).*
Coolwave 2410 UV Curing System, accessed oline at https://emanuals.nordson.com/uvsystems/Files/1612564.pdf on Nov. 2, 11, 2024 (Year: 2024).*
Tian, et al., Enhanced UV photo-stabilization of Nylon 6 filament with reduced graphene oxide/polyurethane nanocomposite inks, International Journal of Clothing Science and Technology 2018; 30(6): 817-827 (Year: 2018).*
Naskar, et al., UV assisted stabilized routes for carbon fiber precursors produced from melt-processible polyacrylonitrile terpolymer, Carbon 2005; 43: 1065-1072 (Year: 2005).*
Gao, Zan, et al., "Graphene Reinforced Carbon Fibers", Science Advances, Apr. 24, 2020, vol. 6 No. 17, pp. 1-10.
Platzer, Norbert A.J., "Stabilization of Polymers and Stabilizer Processes", American Chemical Society, Jan. 1968, pp. vii-xvii.
Shin, Hye Kyoung, et al., "An overview of new oxidation methods for polyacrylonitrile-based carbon fibers", Carbon letters, 2015, vol. 16, No. 1, pp. 11-18.
Kim, So-Young, et al., "Microwave plasma carbonization for the fabrication of polyacrylonitrile-based carbon fiber", Polymer, 2015 (Available online Nov. 20, 2014), vol. 56, pp. 590-595.
Lee, Seung-Wook, et al., "Efficient preparation of carbon fibers using plasma assisted stabilization", Carbon, 2013 (Available online Nov. 10, 2012), vol. 55, pp. 361-365.
Yuan, Huiwu, et al., "Effect of UV irradiation on PAN precursor fibers and stabilization process", Journal of Wuhan University of Technology-Mater, Sci. Ed., Jun. 2011, vol. 26, No. 3, pp. 449-454.
Dang, Wei, et al., "Effects of y-ray irradiation on the radial structure heterogeneity in Polyacrylonitrile fibers during thermal stabilization", Polymers, Aug. 24, 2018, vol. 10, pp. 943-951.
WIPO, "International Search Report and Written Opinion of the International Searching Authority", International Patent Application No. PCT/US2020/037010, mailed Nov. 5, 2020, 13 pages.

* cited by examiner

SYSTEM AND METHOD OF ACCELERATING POLYMER FIBER STABILIZATION VIA IRRADIATION TREATMENT

RELATED APPLICATIONS

The present application is a national stage filing of International Application No. PCT/US2020/037010, filed Jun. 10, 2020, which claims benefit of priority under 35 U.S.C § 119 (e) from U.S. Provisional Application Ser. No. 62/859,746, filed Jun. 11, 2019, entitled "System and Method of Accelerating Polymer Fiber Stabilization via Irradiation Pretreatment"; the disclosures of which are hereby incorporated by reference herein in their entirety.

STATEMENT OF GOVERNMENT INTEREST

This invention was made with government support under Grant No. DE-EE0008195, awarded by the DOE. The government has certain rights in the invention.

FIELD OF INVENTION

The present invention relates generally to treatment of pre-cursor polymeric fibers, tows, yarns, or films using irradiation, and more particularly to reducing the time required to stabilize the pre-cursor polymeric fibers, tows, yarns, or films in preparation for carbonization or other secondary thermochemical processes and the products thereof.

BACKGROUND

Introduction: Uses and Issues with Carbon Fibers and Production of Carbon Fibers Carbon fibers have unique properties, including high strength-to-weight ratio and excellent chemical resistance, which makes them highly attractive for use in industries including the aerospace, military, sporting goods, orthopedic, prosthetic, orthotic, renewable energy, aviation, maritime, and automotive industries. However, due to high cost of production of carbon fibers, their adoption is limited. This high cost comes from factors including the up-front cost of pre-cursor polymeric materials and the cost to stabilize those materials for subsequent thermal treatment (e.g.: carbonization and graphitization for producing carbon fibers).

Pre-Cursor Polymeric Materials

Regarding pre-cursor polymeric materials, polyacrylonitrile (PAN) is the dominating pre-cursor polymer used for the creation of carbon fibers. The cost of such PAN or PAN-based pre-cursor polymers prohibits the widespread industrial use of PAN-derived carbon fibers because it represents more than 50% of the cost of production. (See Gao Z, et al. "Graphene Reinforced Carbon Fibers", Science Advances. 2020. 6 (7): eaaz4191.). The high cost of PAN can be cost prohibitive which creates the need for low-cost alternative precursors to enable new uses of carbon fibers. Methods to produce carbon fibers from other pre-cursor polymeric fibers (e.g.: pitch, lignin, or rayon fibers) have been created. However, these alternative pre-cursor polymeric fibers are less commonly used due to their having a lower carbon yield and lower melting point than PAN, and because carbon fibers derived from those precursors possess poor mechanical properties in comparison with PAN-based carbon fibers. (See Gao Z, et al. "Graphene Reinforced Carbon Fibers", Science Advances. 2020. 6 (7): eaaz4191.).

Thus, there is a long-felt need for a method allowing an alternative pre-cursor to be used in the creation of carbon fibers while maintaining the desirable high strength, high modulus, low density, and high chemical resistance expected in a carbon fiber.

An aspect of an embodiment of the present invention enables, among other things, alternative materials including polyamide and polyethylene to be used as pre-cursor polymeric materials while maintaining the expected mechanical properties in resultant carbon fiber manufactures.

Particularly, irradiation of polymers has been demonstrated to change the mechanical properties of the polymers. (See U.S. Pat. No. 7,381,752 B2, Muratoglu). Irradiation is used in production of PAN-based pre-cursor polymeric fibers to cause a polymerization reaction among acrylonitrile monomers and make them suitable for subsequent spinning into fibers. (See U.S. Pat. No. 8,685,361, Yang et al.). By contrast, an aspect of an embodiment of the present invention utilizes irradiation on already-spun pre-cursor fibers, tows, yarns, or films, rather than as a method of creating fibers.

Again, specifically regarding PAN pre-cursor fibers, limited technical work has shown that ultraviolet irradiation and γ-ray irradiation of PAN pre-cursor fibers may affect the resulting stabilized fiber by increasing structural homogeneity thereof. (See Yuan, et al. "Effect of UV Irradiation on PAN precursor fibers and stabilization process", Journal of Wuhan University of Technology. 2011. Mater. Sci. Ed: 449-454. See also Dang, et al. "Effects of γ-Ray Irradiation on the Radial Structure Heterogeneity in Polyacrylonitrile Fibers during Thermal Stabilization", Polymers. 2018. 10: 943-951.). However, these approaches are limited to costly PAN pre-cursor fibers and do not concern microwave irradiation. Moreover, such approaches did not demonstrate an acceleration of the stabilization process due to their methods of irradiation, and they did not apply stepwise irradiation.

Microwave irradiation has been used following stabilization to treat pitch-based fibers. (See U.S. Pat. No. 4,197,282 to Bailly-Lacresse et al.). Moreover, this approach is limited to pitch-derived fibers and concerns carbonization. (See U.S. Pat. No. 4,197,282 to Bailly-Lacresse et al.) Again, it should be reiterated that alternative pre-cursor polymeric fibers including pitch are less commonly used due to their having a lower carbon yield and lower melting point than PAN, and because carbon fibers derived from those precursors possess poor mechanical properties in comparison with PAN-based carbon fibers. By comparison, an aspect of an embodiment of the present invention utilizes stepwise or non-stepwise irradiation prior to stabilization of the pre-cursor polymeric fibers. Further, unlike the related art, the use of irradiation as depicted in various embodiments of the present disclosure demonstrates an acceleration of the stabilization process for pre-cursor fibers.

Stabilization of Polymeric Fibers, Including PAN Pre-cursors, Generally

According to technical literature, the stabilization-oxidation step for treatment of pre-cursor polymeric fibers is considered one of the most important processes in determining the mechanical properties of a subsequently carbonized fiber. (See Shin, et al. "An Overview of New Oxidation Methods for Polyacrylonitrile-Based Carbon Fibers", Carbon Letters. 2015. 16 (1): 11-18, and U.S. Pat. No. 7,649,078 B1, Paulauskas, et al.). This step is also the most time-consuming and rate-limiting step in carbon fiber manufacturing. (See U.S. Pat. No. 7,649,078 B1, Paulauskas, et al.). During stabilization-oxidation, the pre-cursor polymers undergo a change in chemical structure resulting in a ladder structure that provides flame resistance necessary for subsequent carbonization. (See U.S. Pat. No. 10,344,404 B2, Jo, et al.). If the stabilization step is not performed properly, it can lead to burning or melting of the pre-cursor polymeric fibers during a subsequent thermal treatment (e.g.: carbonization). (See U.S. Pat. No. 10,344,404 B2, Jo, et al.). Significantly, economic estimates indicate that the stabilization step represents at least 20% of the total product cost, more than 30% of the total processing cost, and 70-85% of the total fiber processing time. (See U.S. Pat. No. 7,649,078 B1, Paulauskas, et al.). There is therefore a need in the art for an effective method to provide more efficient stabilization of pre-cursor polymeric fibers.

Several methods of stabilizing PAN-based pre-cursor polymeric fibers have been developed. Traditionally, PAN-based pre-cursors can be stabilized in heated air (thermal stabilization). Stabilization can also be performed by using RF, DC, microwave, or pulsed power to generate a plasma that would effect a more rapid stabilization by converting the oxygen molecules reacting with the fibers to a more highly reactive oxygen species (See U.S. Pat. No. 10,344,404 B2, Jo, et al.). Atmospheric plasma oxidation can also be performed to stabilize pre-cursor materials. PAN-based pre-cursor fibers can also be stabilized by irradiating raw pre-cursor fibers with an electron beam while also applying heat at the same time. (See Korean Pat. App. Pub. No. KR 2011/0115332 A, Jeun, et al.). However, such use of irradiation for a simultaneous, combined radiation and thermal stabilization does not encompass a treatment prior to stabilization. Additionally, art in this area is further limited because it teaches the application of a one-time dose of radiation in a specified quantity, while simultaneously applying heat to achieve stabilization. (See Korean Pat. App. Pub. No. KR 2011/0115332 A, Jeun, et al.). Notably, a method of applying stepwise or non-stepwise irradiation prior to stabilization of non-PAN pre-cursor fibers, as included in an embodiment of an aspect of the present invention, has heretofore not been discovered. Moreover, a method of applying stepwise or non-stepwise irradiation prior to stabilization of pre-cursor polymeric fibers, tows, yarns, or films as included in an embodiment of an aspect of the present invention, has heretofore not been discovered.

Graphene/Other Nanomaterials

As reflected in technical literature and related art, graphene and other nanomaterials such as carbon nanotubes, fullerene, and graphene oxide are promising additives to pre-cursor polymeric fibers which undergo stabilization and subsequent carbonization. (See U.S. Pat. No. 10,344,404 B2, Jo, et al.). Literature published by the inventors of the present invention demonstrates that when low concentrations of graphene are added to PAN pre-cursor fibers, the resultant PAN/graphene composite carbon fibers exhibit increased strength, Young's modulus, and strain. (See Gao Z, et al. "Graphene Reinforced Carbon Fibers", Science Advances. 2020. 6 (7): eaaz4191). Moreover, it should be noted that the current art is limited to application of such nanomaterials to PAN fibers or acrylonitrile monomers in the production of a PAN-derived carbon fibers. This approach to treatment is still unsatisfactory because costly PAN fibers are used to create the carbon fibers. There is therefore a need in the art for an effective invention to provide a means for attaining the benefits of a nanomaterial/polymer-derived carbon fiber without using PAN.

Conclusion

The cost of traditional carbon fiber pre-cursor polymers (PAN) and then the cost of stabilization/oxidation of those pre-cursor polymers makes the widespread use of carbon fibers cost-prohibitive. Indeed, despite the desirable mechanical properties carbon fibers possess and benefits they can provide to the automotive, aviation, trains, water crafts, military, orthopedics, sporting goods, prosthetic, renewable energy, and other industries, their use is currently limited to particularly high-end applications. Though there exist alternative pre-cursor materials such as pitch, rayon, lignin, or other synthetic or bio-sourced materials, a drawback of using such materials instead of PAN is the poor mechanical properties of the resultant carbon fibers when produced with heretofore discovered methods. Likewise, though there exist some proposed methods to reduce the stabilization/oxidation time of carbon fiber pre-cursor materials, such approaches are unsatisfactory because they predominantly concern use of PAN-based pre-cursors.

In light of the above problems and limitations, a need arises for methods specifically intended to treat non-PAN pre-cursors and which will produce carbon fibers with mechanical properties similar to or better than traditional PAN-derived carbon fibers, all while reducing the time necessary to complete the costly stabilization step.

SUMMARY OF ASPECTS OF EXEMPLARY EMBODIMENTS OF THE INVENTION

Overview

Increasing consumer demands for greater fuel efficiency and battery range in automotive vehicles (including automobiles, rail, and air travel) have engineers increasingly utilizing carbon fiber for its superior strength-to-weight ratio. Currently, the prohibitively high cost of carbon fiber relegates the material to high performance and high price applications. However, much greater market share will be realized if the cost of carbon fiber can be reduced by making the production of carbon fiber cheaper. It is expected that cheaper carbon fiber would make lightweight prosthetics more accessible, reduce the weight of combat and vehicle armor, and increase the efficiency of renewable power generation in wind turbines and other applications, among other things. Beyond being a prerequisite for carbon fiber production, stabilization of polymers is used to improve thermal stability, increase ultraviolet resistance, and reduce embrittlement over time. Stabilization could be used to prepare fibers, yarns, tows, and films of polymer fiber for use in harsh environments or for elevated temperature processing (such as formation into a molded shape at temperatures at which un-stabilized fibers would degrade). An aspect of an embodiment of the present invention provides, among other things, the ability to dramatically reduce the cost of carbon fiber production by allowing manufacturers to employ precursor materials that cost much less than the market dominating polyacrylonitrile (PAN) precursor and convert to carbon fiber at less cost. An aspect of an embodiment allows an alternative pre-cursor to be used in the creation of carbon fibers while maintaining the desirable high strength, high modulus, low density, and high chemical resistance expected in a carbon fiber. A further aspect of an embodiment of the present invention provides, among other things, the ability to dramatically reduce cost of producing stabilized fibers, yarns, tows, and films of polymer fiber for uses other than carbonization (e.g.: creation of flame-retardant materials, use in harsh environments, or use in elevated temperature processing). Further, the stabilization technique as disclosed in various embodiments herein may imbue properties in certain polymer fibers that may make them desirable for structural applications and could be used in forming methods that would otherwise damage the un-stabilized fibers. An aspect of an embodiment of the present invention provides, but not limited thereto, the production of stabilized polymer fibers that may be woven into textiles that are used in composites that are autoclaved or compression molded, much like Kevlar and others are currently.

An aspect of an embodiment of the present invention provides, among other things, an approach to treatment and stabilization of pre-cursor polymeric fibers, tows, yarns, or films (also referred to in this disclosure as 'pre-cursor'), thus providing a means of using non-PAN pre-cursor polymeric fibers and reducing stabilization time for the pre-cursor by application of irradiation. In an embodiment, it should be understood that the pre-cursor polymeric fibers, tows, yarns, or films have already been spun (or otherwise prepared). The resulting irradiated, stabilized pre-cursor polymeric fibers, tows yarns, or films can then undergo a subsequent secondary thermochemical process such as carbonization to create carbon fibers. The present inventor submits that a key gap, and research opportunity, is investigating mechanisms to enhance the mechanical properties of low-cost carbon fibers (e.g.: carbon fibers derived from a pre-cursor that is not PAN or PAN-based). This gap is critical to address, as it is foundational to expanding the beneficial use of carbon fibers in industries including but not limited to the automotive, aerospace, orthopedic, prosthetic, orthotic, and renewable energy industries. Whereas carbon fibers have limited practical use in industry due to high cost, the ability to use and produce low-cost carbon fibers presents an opportunity to decrease cost of, for example, battery-powered cars which have gained popularity in recent years and require a significant reduction in weight as compared to traditional vehicles. Likewise, the ability to produce low-cost carbon fibers may revolutionize the professional and amateur sports industries through granting athletes greater accessibility to more effective, high performing tennis rackets, golf clubs, hockey sticks, and archery arrows and bows—all of which are commonly manufactured with carbon fiber reinforced composites. Further, the ability to produce stabilized polymer fibers at a low cost lends opportunities to decrease cost of, among other things, flame retardant materials, materials for use in harsh environments, and textile composites for use in creation of Kevlar and other composites that are autoclaved or compression molded.

An aspect of an embodiment provides a new method and system for treating non-PAN-based pre-cursor polymeric fibers, tows, yarns, and films for use in making stabilized pre-cursor polymers. By applying stepwise or non-stepwise (or a combination or stepwise and non-stepwise) microwave and/or ultraviolet radiation to the pre-cursor polymeric fibers, tows, yarn, or films prior to the stabilization thereof, a reduction in time for the costly stabilization process is achieved. Application of this technique extends to less-costly production of carbon fibers, for uses in industries such as automotive, aviation, aerospace, maritime, trains, medical, military, sporting goods, orthopedic, prosthetic, orthotic, renewable energy, and other industries. The pre-cursor polymeric fibers, tows, yarns, or films may be a multi-component polymer composite comprised of a non-PAN-based polymeric fiber, tow, yarn, or film and at least one or more constituent materials (e.g.: various nanomaterials and/or metallic compounds as described within this disclosure). Carbonization of such pre-cursor polymeric fibers, tows, yarns, or films results in less-costly carbon fibers that perform equally, if not better, than traditional costly PAN-based carbon fibers. Additionally, the stabilized pre-cursor polymeric fibers, tows, yarns, or films may be used in a variety of applications, including the creation of aircraft brake performs, thermal, acoustical and vibration insulation liners, flame resistant apparel, intumescent mesh, and may be further processed to produce stabilized fiber composites for production of Kevlar among other things. As used herein, the term "non-stepwise" refers to any scheme of durations of repetitions of irradiation which is not sequentially longer or sequentially shorter than the first duration of irradiation.

An aspect of an embodiment of the present invention provides, among other things, the use of microwave and/or ultraviolet light irradiation to accelerate the stabilization process of pre-cursor polymeric fibers, tows, yarns, or films and multi-component polymer composites. A method of stepwise irradiation of pre-cursor polymeric fibers, tows, yarns, or films in batch or continuous processing is proposed (along with its related system and an article of manufacture resultant therefrom). A specified duration initial radiation dose may be applied to the fibers, tows, yarns, or films that may be followed by a single or multiple variable-duration radiation dose to the already-irradiated fibers, yarns, tows, or films. The irradiated pre-cursor polymeric fibers, tows, yarns, or films may be cooled after each irradiation step. Briefly, for example in one embodiment, the fibers can cool passively in surrounding air. Alternatively, in other embodiments, the fibers can be cooled actively such as via washing in a liquid or via convection following irradiation. In some embodiments, the above-described irradiation and cooling occurs between 1-5 times (such as shown, for example but not limited thereto in FIG. 1). In some embodiments, the above-described irradiation occurs once prior to stabilization (such as shown, for example but not limited thereto in FIG. 7). This thereby reduces the time required to stabilize polymeric fibers for secondary thermochemical processes including but not limited to carbonization for the creation of carbon fibers.

An aspect of an embodiment of the present invention provides, among other things, a system and method of accelerating polymer fiber stabilization (along with an article of manufacture resultant therefrom).

An aspect of an embodiment of the present invention provides, among other things, a method and system of accelerating polymer fiber stabilization via irradiation treatment (along with an article of manufacture resultant therefrom).

In an embodiment, the irradiation and stabilization method can be used to produce stabilized polymeric materials for uses other than the creation of carbon fibers. For example, it is plausible that a plasma surface treatment may be applied to stabilized polymers to imbue surface hydrophobicity or to increase matrix adhesion if the polymers are a constituent element of a composite.

An aspect of an embodiment of the present invention provides, among other things, a method for treating pre-cursor polymeric fibers, tows, yarns, or films. The method may comprise: irradiating the pre-cursor polymeric fibers, tows, yarns, or films with specified duration exposure to microwaves and/or ultraviolet light; and cooling the irradiated pre-cursor polymeric fibers, tows, yarns, or films. Further, in an embodiment, the method may comprise: irradiating the irradiated pre-cursor polymeric fibers, tows, yarns, or films with specified duration exposure to microwaves and/or ultraviolet light; and cooling the irradiated pre-cursor polymeric fibers, tows, yarns, or films.

An aspect of an embodiment of the present invention provides, among other things, a carbonized graphene-polymer hybrid fiber, tow, yarn, or film composite, comprising: a carbonized graphene-polymer hybrid fiber, tow, yarn, or film composed of carbonized pre-cursor polymeric fibers, tows, yarns, or films; and graphene.

An aspect of an embodiment of the present invention provides, among other things, a pre-cursor polymeric fiber, tow, yarn, or film that is a multi-component polymer composite comprised of a polymeric fiber, tow, yarn, or film and at least one or more constituent materials, wherein the fiber, tow, yarn, or film is irradiated and stabilized.

An aspect of an embodiment of the present invention provides, among other things, a system for treating pre-cursor polymeric fibers, tows, yarns, or films. The system may comprise: an irradiating means for irradiating the pre-cursor polymeric fibers, tows, yarns, or films with specified duration exposure; and a heating means for heating the irradiated pre-cursor polymeric fibers, tows, yarns, or films to achieve stabilization of the pre-cursor polymeric fibers, tows, yarns, or films.

Moreover, it should be appreciated that any of the components or modules referred to with regards to any of the present invention embodiments discussed herein, may be integrally or separately formed with one another. Further, redundant functions or structures of the components or modules may be implemented. Moreover, the various components may be communicated locally and/or remotely with any user or machine/system/computer/processor. Moreover, the various components may be in communication via wireless and/or hardwire or other desirable and available communication means, systems and hardware. Moreover, various components and modules may be substituted with other modules or components that provide similar functions.

It should be appreciated that the device and related components discussed herein may take on all shapes along the entire continual geometric spectrum of manipulation of x, y and z planes to provide and meet the environmental, anatomical, and structural demands and operational requirements. Moreover, locations and alignments of the various components may vary as desired or required.

It should be appreciated that various sizes, dimensions, contours, rigidity, shapes, flexibility and materials of any of the components or portions of components in the various embodiments discussed throughout may be varied and utilized as desired or required.

It should be appreciated that while some dimensions are provided on the aforementioned figures, the device may constitute various sizes, dimensions, contours, rigidity, shapes, flexibility and materials as it pertains to the components or portions of components of the device, and therefore may be varied and utilized as desired or required.

Although example embodiments of the present disclosure are explained in detail herein, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

It must also be noted that, as used in the specification and the appended claims, the singular forms "a," "an" and "the" include plural referents unless the context clearly dictates otherwise. Ranges may be expressed herein as from "about" or "approximately" one particular value and/or to "about" or "approximately" another particular value. When such a range is expressed, other exemplary embodiments include from the one particular value and/or to the other particular value.

It should be appreciated that any value or range disclosed herein should not be considered limiting, but rather may be implemented at a greater or lesser value or range and should be considered employed within the context of the invention.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose. It is also to be understood that the mention of one or more steps of a method does not preclude the presence of additional method steps or intervening method steps between those steps expressly identified. Steps of a method may be performed in a different order than those described herein without departing from the scope of the present disclosure. Similarly, it is also to be understood that the mention of one or more components in a device or system does not preclude the presence of additional components or intervening components between those components expressly identified.

Some references, which may include various patents, patent applications, and publications, are cited in a reference list and discussed in the disclosure provided herein. The citation and/or discussion of such references is provided merely to clarify the description of the present disclosure and is not an admission that any such reference is "prior art" to any aspects of the present disclosure described herein. In terms of notation, "[n]" corresponds to the $n^{th}$ reference in the list. All references cited and discussed in this specification are incorporated herein by reference in their entireties and to the same extent as if each reference was individually incorporated by reference.

The term "about," as used herein, means approximately, in the region of, roughly, or around. When the term "about" is used in conjunction with a numerical range, it modifies that range by extending the boundaries above and below the numerical values set forth. In general, the term "about" is used herein to modify a numerical value above and below the stated value by a variance of 10%. In one aspect, the term "about" means plus or minus 10% of the numerical value of the number with which it is being used. Therefore, about 50% means in the range of 45%-55%. Numerical ranges recited herein by endpoints include all numbers and fractions subsumed within that range (e.g. 1 to 5 includes 1, 1.5, 2, 2.75, 3, 3.90, 4, 4.24, and 5). Similarly, numerical ranges recited herein by endpoints include subranges subsumed within that range (e.g. 1 to 5 includes 1-1.5, 1.5-2, 2-2.75, 2.75-3, 3-3.90, 3.90-4, 4-4.24, 4.24-5, 2-5, 3-5, 1-4, and 2-4). It is also to be understood that all numbers and fractions thereof are presumed to be modified by the term "about."

The invention itself, together with further objects and attendant advantages, will best be understood by reference to the following detailed description, taken in conjunction with the accompanying drawings.

These and other objects, along with advantages and features of various aspects of embodiments of the invention disclosed herein, will be made more apparent from the description, drawings and claims that follow.

BRIEF DESCRIPTION OF THE DRAWINGS

The foregoing and other objects, features and advantages of the present invention, as well as the invention itself, will be more fully understood from the following description of preferred embodiments, when read together with the accompanying drawings.

The accompanying drawings, which are incorporated into and form a part of the instant specification, illustrate several aspects and embodiments of the present invention and, together with the description herein, serve to explain the principles of the invention. The drawings are provided only for the purpose of illustrating select embodiments of the invention and are not to be construed as limiting the invention.

DETAILED DESCRIPTION OF EXEMPLARY EMBODIMENTS

Method

Figure 7:
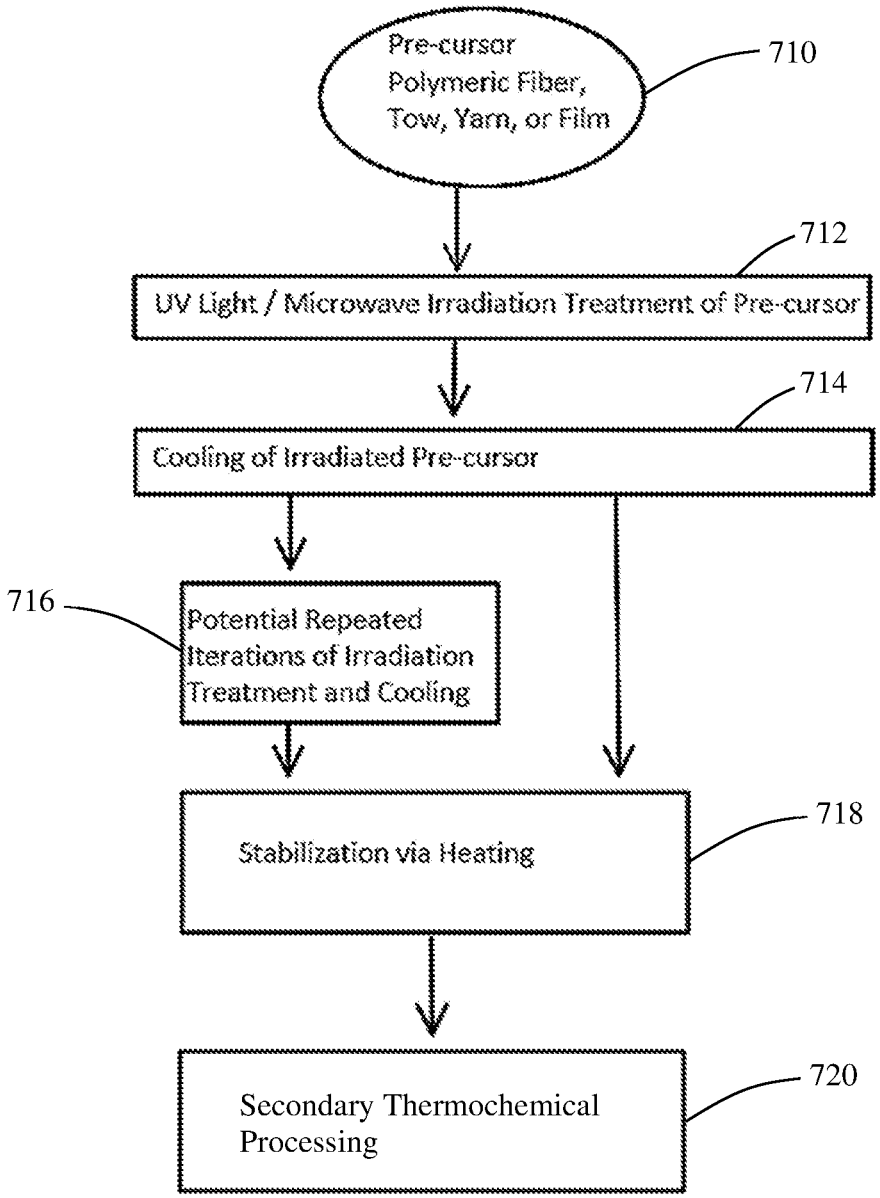
FIG. 7 provides a flowchart demonstrating the irradiation treatment and subsequent stabilization of pre-cursor polymeric fibers, tows, yarns, or films according to an embodiment of the method of the present disclosure.

An aspect of an embodiment of the present invention provides, but is not limited to, a method for treating pre-cursor polymeric fibers, tows, yarns, or films comprising: irradiating the pre-cursor polymeric fibers, tows, yarns, or films with specified duration exposure to microwaves and/or ultraviolet light; and cooling the irradiated pre-cursor polymeric fibers, tows, yarns, or films. In an embodiment, it should be understood that the pre-cursor polymeric fibers, tows, yarns, or films have already been spun (or otherwise prepared). FIG. 7 schematically depicts an example of such an embodiment: wherein at step 710, the pre-cursor polymeric fiber, tow, yarn, or film is provided and then irradiated, at step 712, by exposure to ultraviolet light or microwave radiation; and is then cooled at step 714. An aspect of an embodiment provides that said irradiation has a specified duration of about 5 seconds to about 60 seconds. A further embodiment provides that said irradiation has a specified duration of about 60 seconds to about 10 minutes. Another embodiment provides that said irradiation has a specified duration of about 10 minutes to about 20 minutes. An aspect of an embodiment provides that the irradiation has a specified duration of about 20 minutes to about 30 minutes. A further embodiment of said irradiation provides a specified duration of about 30 minutes to about 45 minutes. Additionally, an aspect of an embodiment of the irradiation method provides that the specified duration of irradiation be about 45 minutes to about 60 minutes. Thereafter, and which will be discussed further below, various heating processes may be implemented upon the irradiated pre-cursor.

Figure 1:
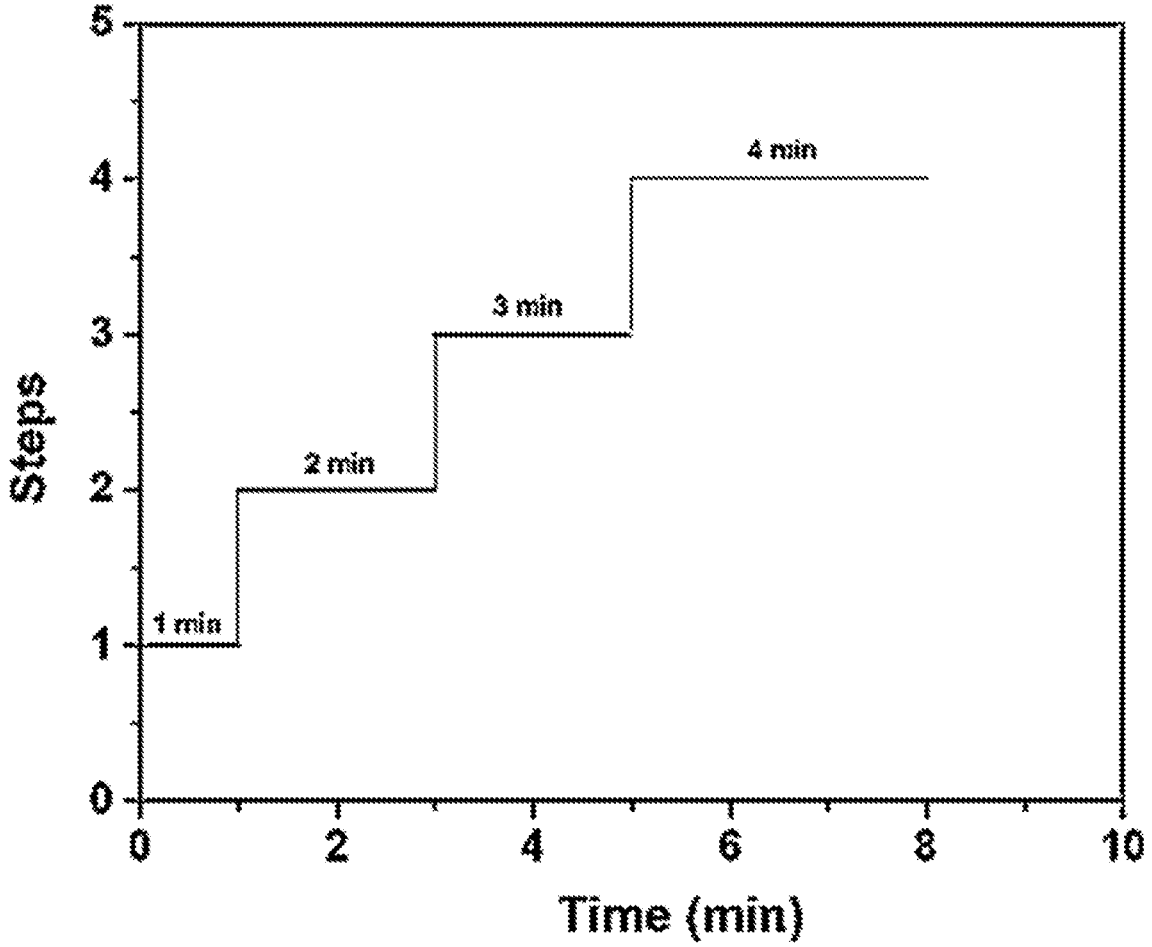
FIG. 1 graphically illustrates a step-wise microwave irradiation scheme as discussed in the Example and Experimental Results Set No. 1.

An aspect of an embodiment provides re-irradiating the irradiated pre-cursor polymeric fibers, tows, yarns, or films with specified duration exposure to microwaves and/or ultraviolet light; and cooling the re-irradiated pre-cursor polymeric fibers, tows, yarns, or films. FIG. 7 schematically depicts an example of such an embodiment: wherein at step 710, the pre-cursor polymeric fiber, tow, yarn, or film is provided and is then is irradiated, at step 712, by exposure to ultraviolet light or microwave radiation; is then cooled at step 714; and then undergoes repeated iterations of irradiation and cooling, at step 716. In an aspect of an embodiment, the re-irradiation and cooling may be repeated between 5 and 10 times. In a further aspect of an embodiment, the re-irradiation and cooling is repeated between 1 and 4 times. Notably, an embodiment of the re-irradiation method may provide for specified duration exposure to microwaves and/or ultraviolet light which is of a longer, shorter, or equal duration as that of the duration of the first irradiation. FIG. 1 represents an embodiment of the present invention wherein the duration of repeated instances of irradiation (re-irradiation) are sequentially longer. It should also be appreciated that the step-wise irradiation and re-irradiation depicted in FIG. 1 may occur over a fewer or greater number of irradiation steps in other embodiments. An aspect of an embodiment provides that each instance of said re-irradiation occurs over a specified duration comprising one of several ranges: about 5 seconds to about 60 seconds; about 60 seconds to about 10 minutes; about 10 minutes to about 20 minutes; about 20 minutes to about 30 minutes; about 30 minutes to about 45 minutes; about 45 minutes to about 60 minutes; about 60 minutes to about 120 minutes. Thereafter, and which will be discussed further below, various heating processes may be implemented upon the irradiated pre-cursor.

An aspect of an embodiment of the present invention provides, but not limited thereto, irradiating the pre-cursor polymeric fibers, tows, yarns, or films by exposing the pre-cursor polymeric fibers, tows, yarns, or films to microwave frequencies in the range of about 300 Hz to about 300 MHz. A further embodiment provides irradiating the pre-cursor polymeric fibers, tows, yarns, or films by exposing the pre-cursor polymeric fibers, tows, yarns, or films to microwave frequency of about 2.45 GHZ. An aspect of an embodiment of the present invention provides, but not limited thereto, irradiating the pre-cursor polymeric fibers, tows, yarns, or films by exposing the pre-cursor polymeric fibers, tows, yarns, or films to ultraviolet light wavelengths in the range of about 10 nm to about 405 nm. An aspect of an embodiment of the present invention provides, but not limited thereto, irradiating the pre-cursor polymeric fibers, tows, yarns, or films by exposing the pre-cursor polymeric fibers, tows, yarns, or films to ultraviolet light wavelength of about 405 nm. Other parameters for microwave frequency and ultraviolet light wavelength of the irradiation and re-irradiation are considered embodiments of the present invention, as such parameters can be adjusted for different compositions of pre-cursor polymeric fibers, tows, yarns, or films to be employed in the context of the various embodiments of the present invention disclosed herein.

An aspect of an embodiment of the present invention provides that each instance of the irradiation and re-irradiation of the pre-cursor polymeric fibers, tows, yarns, or films is applied at a power of a range between about 100 W and about 100 kW. A further embodiment provides that each instance of the irradiation and re-irradiation of the pre-cursor polymeric fibers, tows, yarns, or films is applied at a power of a range between about 100 W and about 1000 W. Another embodiment provides that each instance of the irradiation and re-irradiation of the precursor polymeric fibers, tows, yarns, or films is applied at a power of about 700 W. Other parameters for power at which irradiation and re-irradiation is applied to the pre-cursor polymeric fibers, tows, yarns, or films are considered embodiments of the present invention, as the power can be adjusted for different heating environments or machines (e.g.: different types of furnaces, ovens, or microwave devices) to be employed in the context of the various embodiments of the present invention disclosed herein.

An aspect of an embodiment of the present invention provides heating the cooled irradiated pre-cursor polymeric fibers, tows, yarns, or films to achieve stabilization of said pre-cursor polymeric fibers, tows, or yarns. Notably, performance of the stabilization can occur after one cycle of irradiation and cooling of the pre-cursor polymeric fibers, tows, yarns, or films according to various embodiments presented herein. FIG. 7 schematically depicts an example of such an embodiment: wherein at step 710, the pre-cursor polymeric fiber, tow, yarn, or film is provided and then is irradiated, at step 712, by exposure to ultraviolet light or microwave radiation; is then cooled at step 714; and then undergoes stabilization via heating at step 718. Additionally, performance of this stabilization can occur following the repeated irradiation and cooling of the pre-cursor polymeric fibers, tows, yarns, or films according to various embodiments presented herein. FIG. 7 schematically depicts an example of such an embodiment: wherein at step 710, the pre-cursor polymeric fiber, tow, yarn, or film is provided and then is irradiated, at step 712, by exposure to ultraviolet light or microwave radiation; is then cooled at step 714; then undergoes repeated iterations of irradiation and cooling at step 716; and then undergoes stabilization via heating at step 718. By conducting any of the various embodiments of the irradiation treatment (e.g.: with a single instance of irradiation or with multiple instances of irradiation) as depicted in the present disclosure or any variations thereof, there is a reduction in stabilization processing time for the pre-cursor polymeric fibers, tows, yarns, or films.

Figure 3:
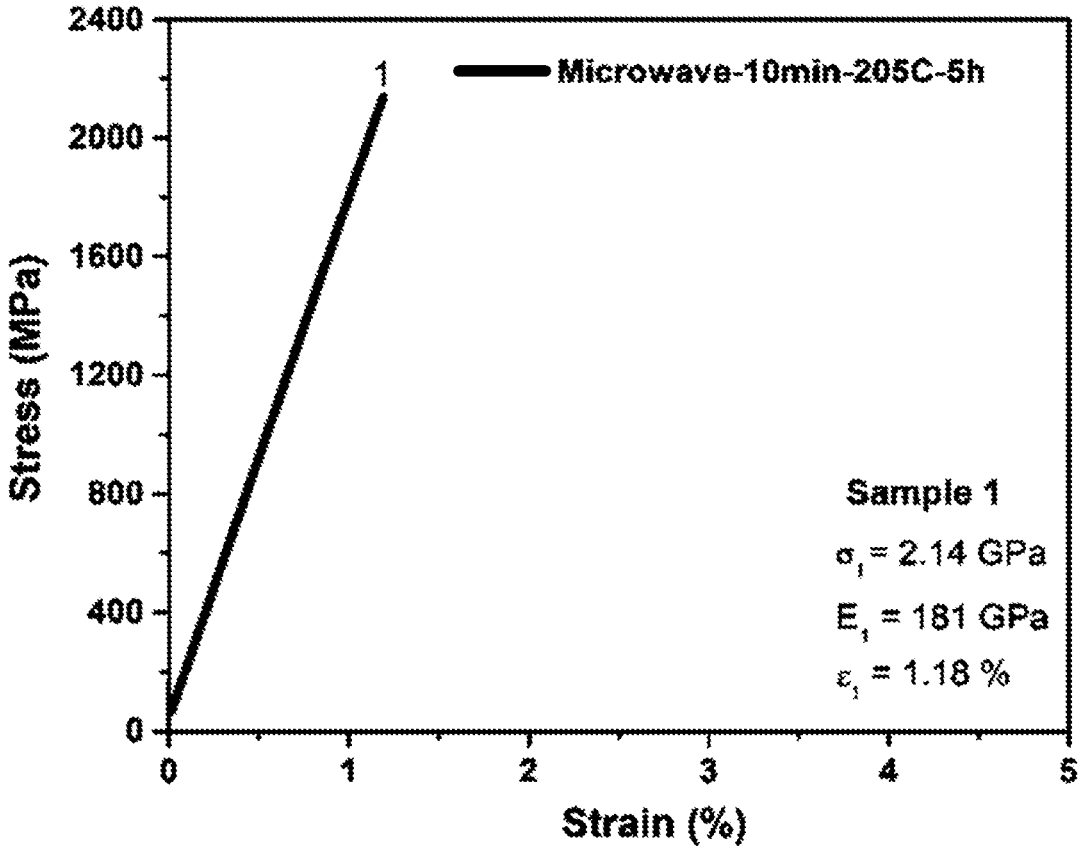
FIG. 3 graphically illustrates a stress strain plot showing performance of fibers resulting from an example embodiment of the microwave treatment process according to the present disclosure.
Figure 5:
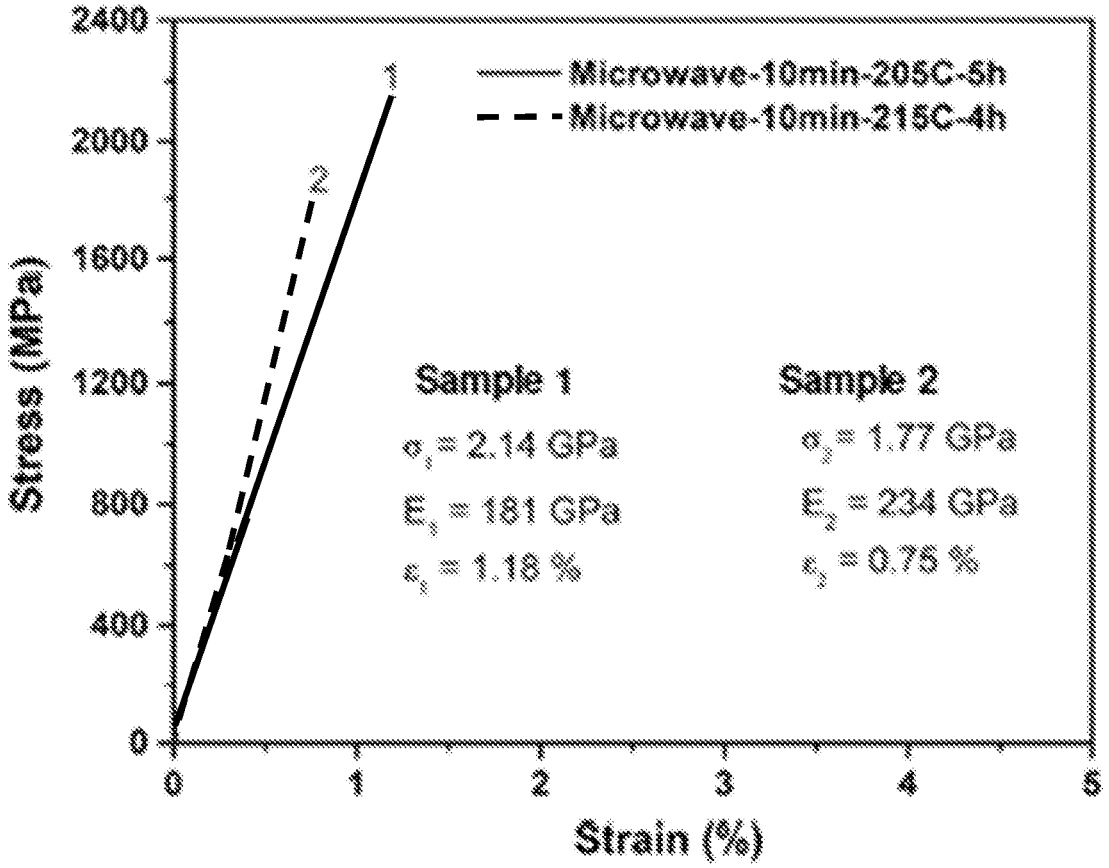
FIG. 5 graphically illustrates a stress strain plot showing performance of nylon/graphene fibers resulting from microwave treatment and oxidation at different temperature and time according to an embodiment of the method of the present disclosure.

The reduction in stabilization processing time stands to reduce the production cost of stabilized polymer fibers as well as the production cost of further conversions of stabilized polymeric fibers including but not limited to carbon fibers and carbon composite fibers. The cost reduction is achieved by reducing the required duration of the costly thermal oxidation process required to achieve stabilized fibers. The parameters associated with the microwave and/or ultraviolet irradiation process described in the aspects of various embodiments of the invention may be varied to optimize the production of the desired fibers based on the input material and desired fiber properties. An aspect of an embodiment of the present invention thus provides, but not limited thereto, thermal stabilization of the irradiated pre-cursor polymeric fibers, tows, yarns, or films by heat between about 150° C. and about 300° C. An aspect of an embodiment provides thermal stabilization of the irradiated pre-cursor polymeric fibers, tows, yarns, or films by heat between about 200° C. to about 250° C. A further aspect of an embodiment provides thermal stabilization of the irradiated pre-cursor polymeric fibers, tows, yarns, or films by heat between about 250° C. to about 300° C. An additional aspect of an embodiment provides thermal stabilization of the irradiated pre-cursor polymeric fibers, tows, yarns, or films by heat between about 200° C. and about 215° C. An aspect of an embodiment provides that said stabilization occurs over a duration comprising one of several ranges between about 1 hour and about 25 hours. In an embodiment, said stabilization occurs over about 15 to about 25 hours. In another embodiment, said stabilization occurs over about 10 to about 15 hours. In another embodiment, said stabilization occurs over about 5 to about 10 hours. In a further embodiment, the stabilization is provided over a duration of about 2 hours to about 5 hours. In an additional embodiment, the stabilization is provided over a duration of about 1 to about 2 hours. FIG. 3 graphically depicts the properties of a pre-cursor polymeric fiber treated with an example embodiment of the method according to the present disclosure: wherein Sample 1 pre-cursor polymeric fibers are exposed to 10 minutes of microwave irradiation, then subsequently stabilized at a temperature of 205° C. over a duration of 5 hours Likewise, FIG. 5 graphically illustrates a stress strain plot showing performance of Sample 1 and Sample 2 of nylon/graphene fibers resulting from microwave treatment and oxidation-stabilization at different temperatures and times according to various embodiments of the method of the present disclosure. Other parameters for temperature and duration of stabilization are considered embodiments of the present invention, as such parameters can be adjusted for different compositions of pre-cursor polymeric fibers, tows, yarns, or films to be employed in the context of the various embodiments of the present invention disclosed herein.

An aspect of an embodiment of the present invention provides, among other things, achieving a secondary thermochemical process to the irradiated, stabilized pre-cursor polymeric fibers, tows, yarns, or films via the application of at least one or more additional heating occurrences. An aspect of an embodiment provides that said secondary thermochemical process may comprise: thermal carbonization or microwave-assisted plasma carbonization of the pre-cursor polymeric fibers, tows, yarns, or films.

FIG. 7 schematically depicts an example of an embodiment including thermal carbonization: wherein at step 710, the pre-cursor polymeric fiber, tow, yarn, or film is provided and is then irradiated, at step 712, by exposure to ultraviolet light or microwave radiation; is then cooled at step 714; then undergoes stabilization via heating at step 718; and is then carbonized at step 720. Additionally, performance of this carbonization can occur following the stabilization of repeatedly irradiated and cooled pre-cursor polymeric fibers, tows, yarns, or films according to various embodiments presented herein. FIG. 7 schematically depicts an example of such an embodiment: wherein at step 710, the pre-cursor polymeric fiber, tow, yarn, or film is provided and then is irradiated, at step 712, by exposure to ultraviolet light or microwave radiation; is then cooled at step 714; then undergoes repeated iterations of irradiation and cooling at step 716; then undergoes stabilization via heating at step 718; and then is carbonized at step 720.

An aspect of an embodiment provides carbonization of the irradiated, stabilized pre-cursor polymeric fibers, tows, yarns, or films, wherein said carbonization is achieved by applying additional heat at a rate in the range of about 0.5° C. to about 25° C. per minute to a final temperature in the range of about 500° C. to about 3000° C. An embodiment provides the carbonization by applying additional heat at a rate in the range of about 0.5° C. to about 25° C. per minute to a final temperature in the range of about 1000° C. to about 1700° C.

An aspect of an embodiment of the present invention provides carbonization of the irradiated, stabilized pre-cursor polymeric fibers, tows, yarns, or films wherein the carbonization occurs over a duration of about 15 minutes to about 3 hours. Another embodiment provides carbonization of the irradiated, stabilized pre-cursor polymeric fibers over a duration of about 1 hour to about 2 hours. In another preferred embodiment, the carbonization is provided over a duration of about 30 minutes to about 60 minutes. In yet another embodiment, the carbonization is provided over a duration of 30 minutes. Other parameters for temperature and duration of carbonization are considered embodiments of the present invention, as such parameters can be adjusted for different compositions of pre-cursor polymeric fibers, tows, yarns, or films to be employed in the context of the various embodiments of the present invention disclosed herein.

An aspect of an embodiment of the present invention provides, but not limited thereto, a pre-cursor polymeric fiber, tow, yarn, or film that is a multi-component polymer composite comprised of a polymeric fiber, tow, yarn or film and at least one or more constituent materials. An aspect of an embodiment provides that said at least one or more constituent materials defines a constituent content having a concentration comprising a range of about 0.01% to about 1% of the multi-component polymer composite. An aspect of an embodiment provides that said at least one or more constituent materials defines a constituent content having a concentration comprising about 0.05% to about 0.1% of the multi-component polymer composite. A further embodiment provides, among other things, that said at least one or more constituent materials of the multi-component polymer composite may comprise the following: graphene, borophene, boron carbide, carbon nanotubes, or other nanomaterials. A further embodiment provides that said at least one or more constituent materials of the multi-component polymer composite comprise graphene. Another embodiment provides, among other things, that said at least one or more constituent materials of the multi-component polymer composite may comprise one of the following metallic compounds: CuCl, $CuCl_2$, or $FeCl_3$. An aspect of an embodiment provides that said at least one or more constituent materials of the multi-component polymer composite comprise CuCl. A further aspect of an embodiment provides, but not limited thereto, that said at least one or more constituent materials of the multi-component polymer composite comprise $FeCl_3$. An aspect of an embodiment provides that the polymeric fiber of the multi-component polymer composite comprises: polyamide, polyethylene, high-density polyethylene (HDPE), ultra-high molecular weight polyethylene (UHMWPE), other bio-sourced polymer, or a non-PAN-based polymer. An aspect of an embodiment provides that the polymeric fiber of the multi-component polymer composite comprises polyamide. An aspect of an embodiment provides that the polymeric fiber of the multi-component polymer composite comprises polyethylene.

Figure 4:
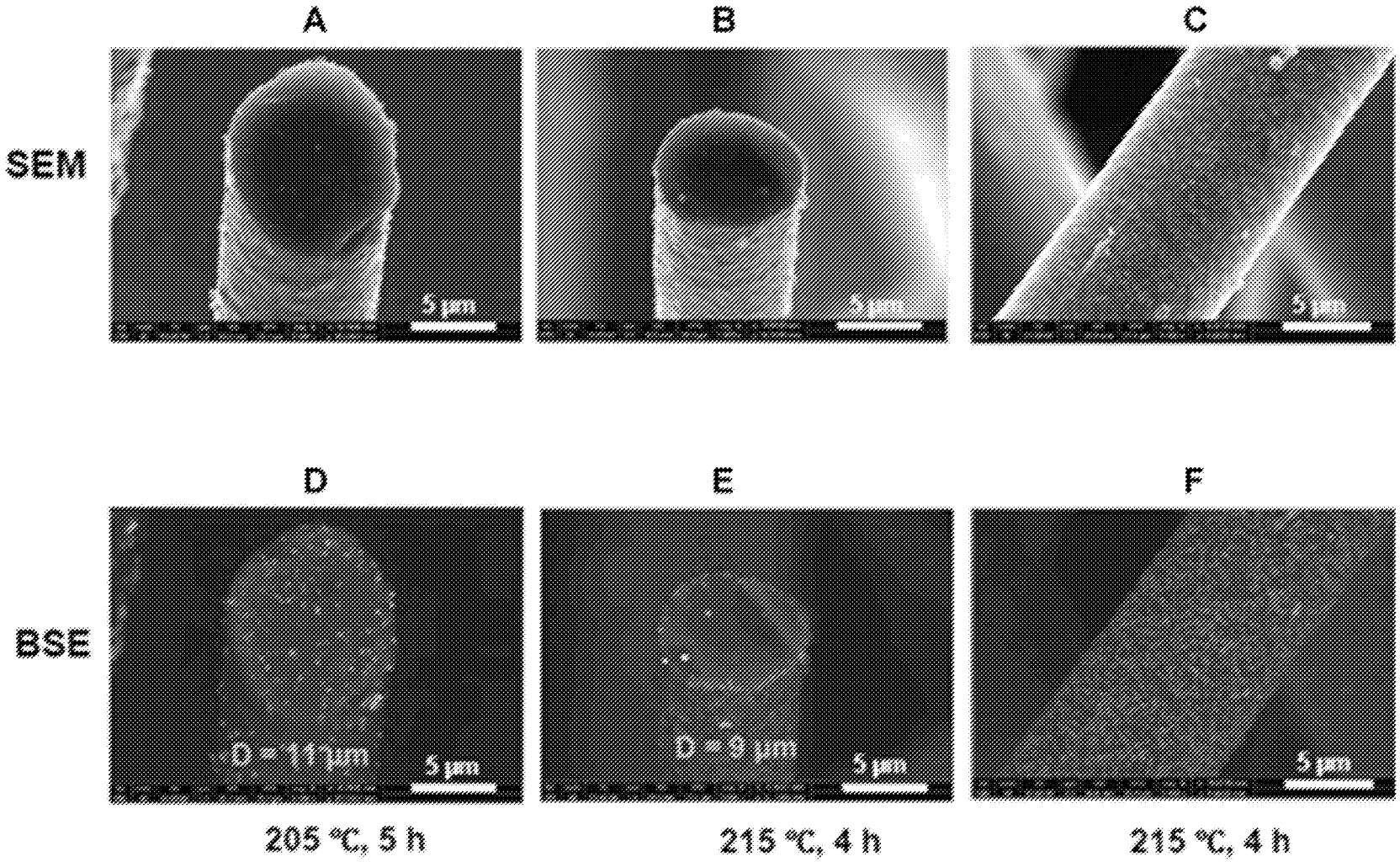
FIGS. 4A-C provide scanning electron microscope (SEM) micrograph images and FIGS. 4D-E provide backscattered electrons (BSE) micrograph images of nylon/graphene based carbon fiber produced from precursor fibers that were treated with microwaves with different oxidation temperature and time as per an example embodiment of the method according to the present disclosure.

An aspect of an embodiment of the present invention provides, among other things, that the treated pre-cursor polymeric fibers, tows, yarns, or films have a diameter in the range of about 5 μm to about 250 μm. FIG. 4 depicts scanning electron microscope (SEM) micrograph images of an embodiment of the treated pre-cursor polymeric fibers (Figures A, B, C), which can be produced by practicing various embodiments of the method provided in the present disclosure or by practicing combinations or variations thereof. FIG. 4 also depicts backscattered electron (BSE) micrograph images of an embodiment of the treated pre-cursor polymeric fibers (Figures D, E, F), which can be produced by practicing various embodiments of the method provided in the present disclosure or by practicing combinations or variations thereof. Specifically, FIGS. 4A and 4D depict an embodiment of a treated pre-cursor polymeric fiber with a diameters of 11 μm. As well, FIGS. 4B and 4E depict an embodiment of a treated pre-cursor polymeric fiber with a diameter of 9 μm.

Carbonized Graphene-Polymer Hybrid Fiber, Composite

Figure 2:
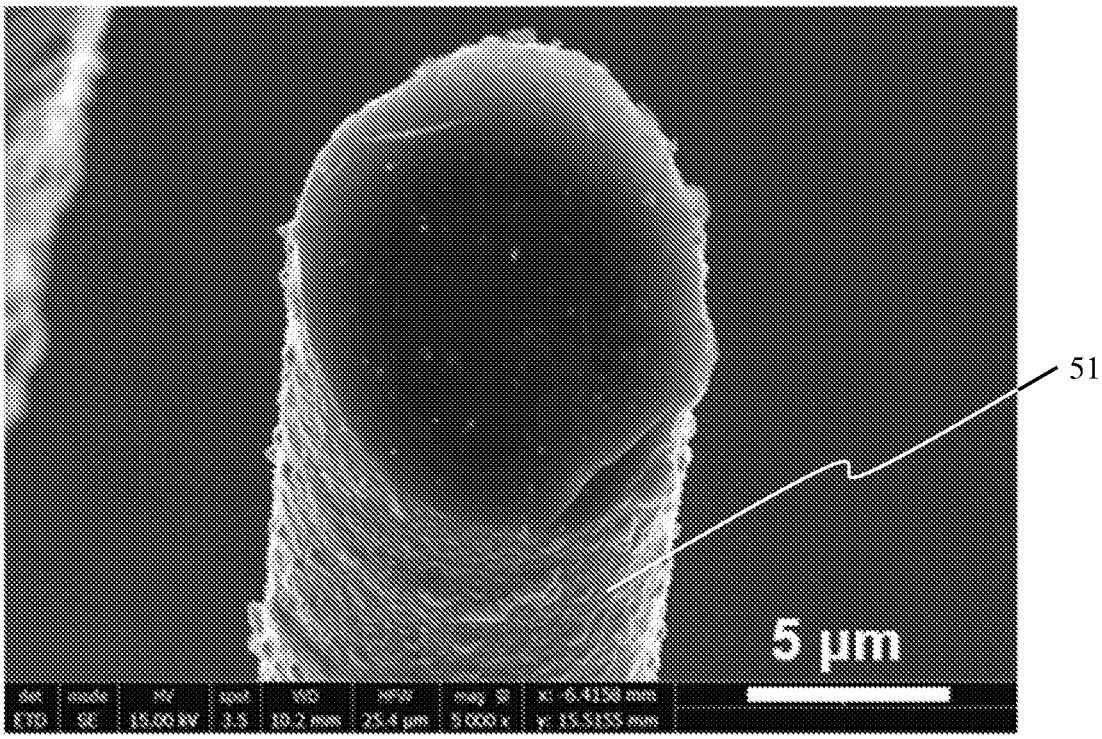
FIG. 2 provides a scanning electron microscope (SEM) micrograph image of nylon/graphene based carbon fiber produced from pre-cursor fibers that were treated with microwaves per an example embodiment of the method according to the present disclosure.

An aspect of an embodiment of the present invention provides, among other things, a carbonized graphene-polymer hybrid fiber, tow, yarn or film composite and related method of treating and stabilizing the same. An aspect of an embodiment provides a carbonized graphene-polymer hybrid fiber, tow, yarn, or film composite comprising: a carbonized graphene-polymer hybrid fiber, tow yarn, or film composed of carbonized pre-cursor polymeric fibers, tows, yarns, or films; and graphene. FIG. 2 provides an SEM micrograph image of a possible embodiment of said carbonized graphene-polymer hybrid fiber, tow, yarn, or film composite 51, comprising a nylon/graphene based carbon fiber produced from pre-cursor fibers that were treated with microwaves per an example embodiment of the method according to the present disclosure. An aspect of an embodiment provides that the graphene component of the carbonized graphene-polymer hybrid fiber, tow, yarn, or film composite is in the form of graphene sheets. Another embodiment provides that the graphene sheets are present on the interior and exterior of the carbonized graphene-polymer hybrid fiber, tow, yarn, or film composite. An aspect of an embodiment of the carbonized graphene-polymer hybrid fiber, tow, yarn, or film composite provides that the graphene is present in an amount ranging from about 0.01% to about 1% by weight based on total weight of the composite. A further aspect of an embodiment of the carbonized graphene-polymer hybrid fiber, tow, yarn, or film composite provides that the graphene is present in an amount ranging from about 0.05% to about 0.1% based on total weight of the composite. An aspect of an embodiment provides, but not limited thereto, that the pre-cursor polymeric fibers, tows, yarns, or films of the carbonized graphene-polymer hybrid fiber, tow, yarn, or film composite comprise: polyamide, polyethylene, high-density polyethylene (HDPE), ultra-high molecular weight polyethylene (UHMWPE), other bio-sourced polymer, or a non-PAN-based polymer. An embodiment provides that said pre-cursor polymeric fibers, tows, yarns, or films are polyamide. An embodiment provides that said pre-cursor polymeric fibers, tows, yarns, or films are polyethylene.

An aspect of an embodiment provides, but not limited thereto, a carbonized graphene-polymer hybrid fiber, tow, yarn or film composite with varied values for strength, elastic modulus, and strain. An example of such an embodiment may possess strength in the range of about 1.00 GPa to about 3.50 GPa; an elastic modulus in the range of about 100 GPa to about 350 GPa; and strain in the range of about 0.6% to about 2.5% (such as shown, for example and not limited thereto in FIGS. 3, 5). Another example of such an embodiment may possess strength in the range of about 1.86 GPa to about 2.06 GPa. A further embodiment may possess an elastic modulus in the range of about 176 GPA to about 192 GPa. Another possible embodiment may possess strain in the range of about 1.05% to about 1.17%.

An aspect of an embodiment of the present invention provides, among other things, a carbonized graphene-polyamide hybrid fiber and method of producing the same (such as shown, for example and not limited thereto in FIG. 2).

An aspect of an embodiment of the present invention provides, among other things, a carbonized graphene-polyethylene hybrid fiber and method of producing the same.

Pre-Cursor Polymeric Fiber (Multi-Component Polymer Composite)

Figure 6:
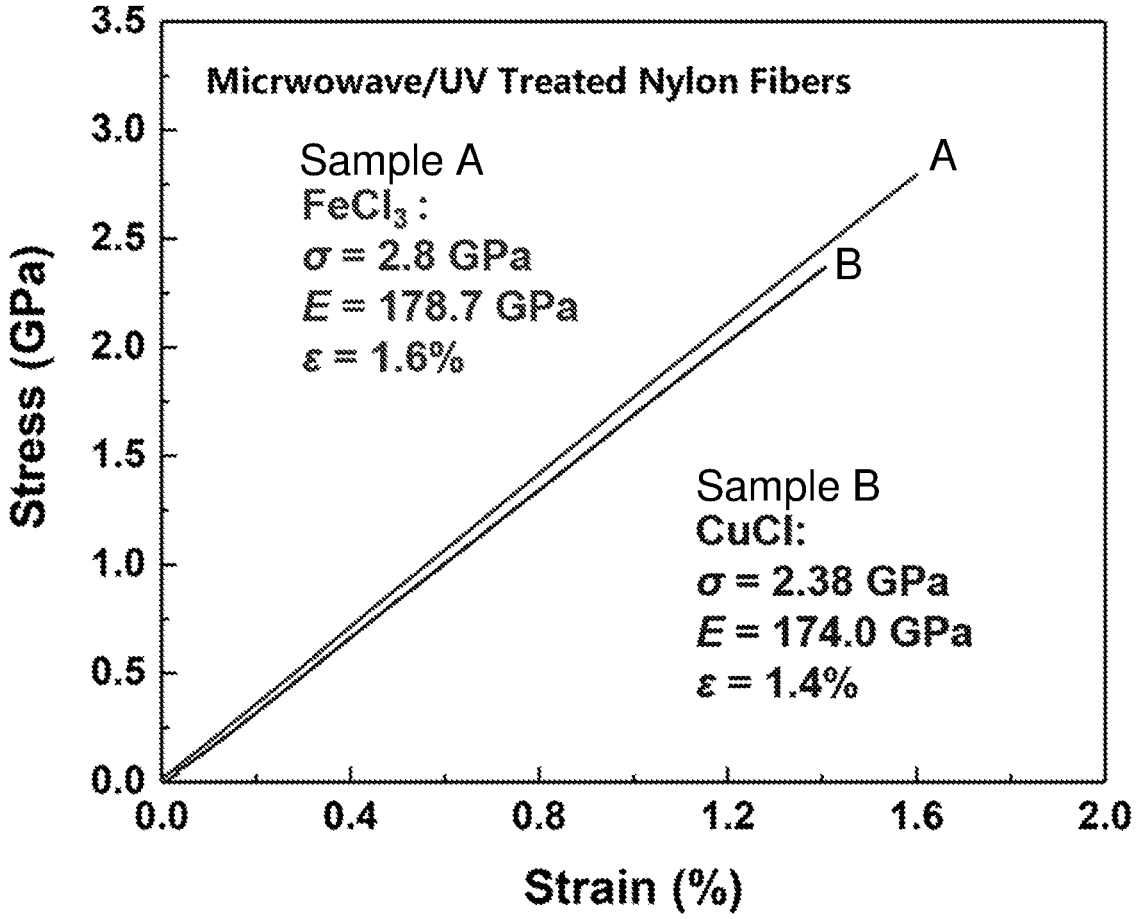
FIG. 6 graphically illustrates a stress strain plot showing performance of nylon fibers resulting from combined microwave and ultraviolet (UV) light treatment with two different metal salt solutions and oxidation according to an embodiment of the method of the present disclosure.

An aspect of an embodiment of the present invention provides, among other things, a pre-cursor polymeric fiber that is a multi-component polymer composite comprised of a polymeric fiber, tow, yarn, or film and at least one or more constituent materials, wherein said fiber, tow, yarn, or film is irradiated and stabilized. An aspect of an embodiment provides that said at least one or more constituent materials defines a constituent content have a concentration comprising a range of about 0.01% to about 1% of the multi-component polymer composite. An aspect of an embodiment provides that said at least one or more constituent materials comprise graphene, borophene, boron carbide, carbon nanotubes, or other nanomaterials. An aspect of an embodiment provides that the polymeric fiber component of the pre-cursor polymeric fiber, tow, yarn, or film comprises: polyamide, polyethylene, HDPE, UHMWPE, other bio-sourced polymer, or a non-PAN-based polymer; and at least one or more constituent materials. An embodiment of said multi-component polymer composite may comprise, among other things, polyamide and graphene (such as shown, for example and not limited thereto in FIG. 2, and referenced as 51). An aspect of embodiment provides that the at least one or more constituent materials within the multi-component polymer composite comprises of one of the following metallic compounds: CuCl, $CuCl_2$, or $FeCl_3$. An embodiment of said multi-component polymer composite may comprise, among other things, polyamide and CuCl (such as shown, for example and not limited thereto in FIG. 6, and referenced as Sample B). A further embodiment of said multi-component polymer composite may comprise, among other things, polyamide and $FeCl_3$ (such as shown, for example and not limited thereto in FIG. 6, and referenced as Sample A). FIG. 6 graphically illustrates a stress strain plot showing performance of nylon fibers resulting from combined microwave and ultraviolet light treatment with two different metal salt solutions and oxidation according to an embodiment of the method of the present disclosure.

An aspect of an embodiment provides that the pre-cursor polymeric fiber, tow, yarn, or film (e.g.: the multi-component polymer composite) is carbonized. An aspect of an embodiment provides, but not limited thereto, a carbonized pre-cursor polymeric fiber, tow, yarn or film with varied values for strength, elastic modulus, and strain. An example of such an embodiment may possess strength in the range of about 1.00 GPa to about 3.50 GPa; an elastic modulus in the range of about 100 GPa to about 350 GPa; and strain in the range of about 0.6% to about 2.5% (such as shown, for example and not limited thereto in FIGS. 3, 5, 6). Another example of such an embodiment may possess strength in the range of about 1.86 GPa to about 2.06 GPa. A further embodiment may possess an elastic modulus in the range of about 176 GPA to about 192 GPa. Another possible embodiment may possess strain in the range of about 1.05% to about 1.17%.

System

Figure 8:
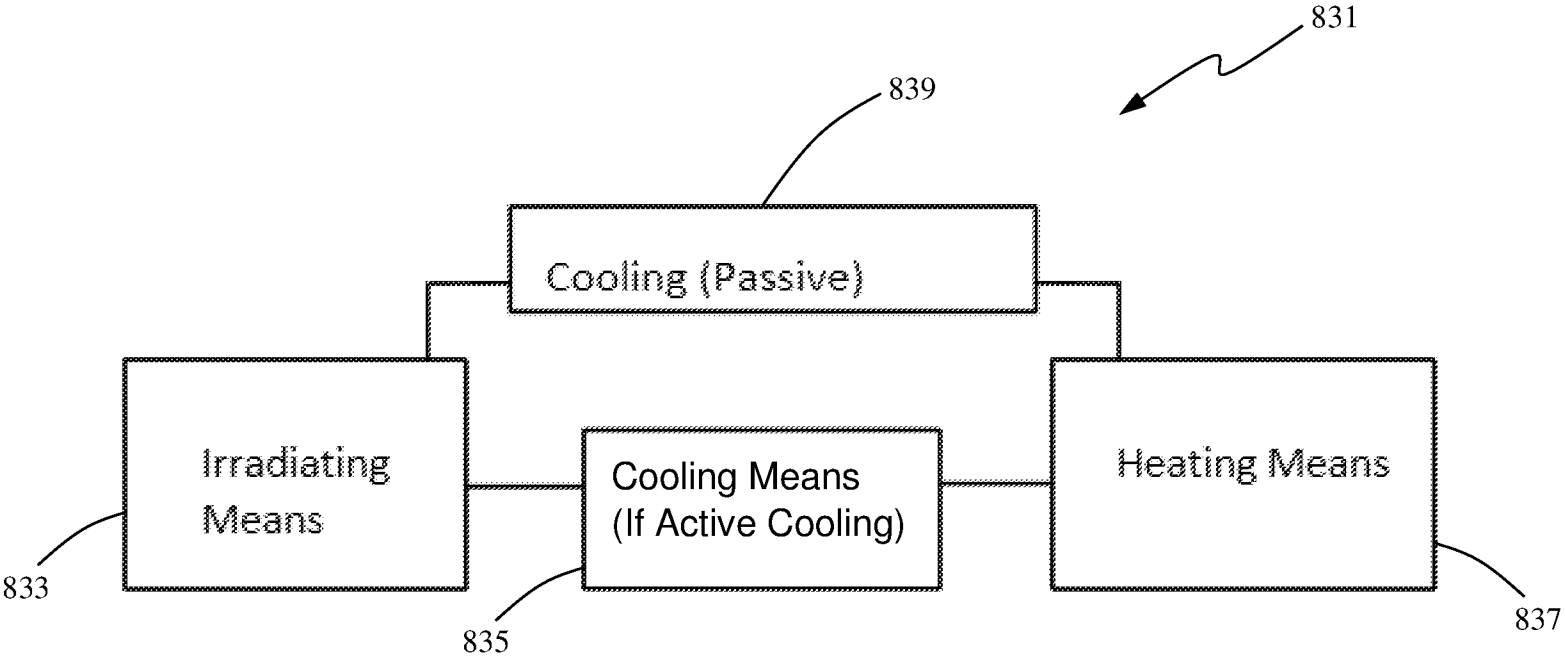
FIG. 8 schematically illustrates a system reflecting the irradiation treatment and subsequent stabilization of pre-cursor polymeric fibers, tows, yarns, or films according to an embodiment of the system of the present disclosure.

An aspect of an embodiment of the present invention shall deploy a system to treat pre-cursor polymeric fibers, tows, tarns, or films as described in other embodiments, wherein the precursors are irradiated by an irradiating means and stabilized by a heating means (such as shown, for example and not limited thereto in FIG. 8). In an embodiment, it should be understood that the pre-cursor polymeric fibers, tows, yarns, or films have already been spun (or otherwise prepared). FIG. 8 schematically illustrates an example embodiment of the system 831 that may comprise an irradiating means 833 to irradiate pre-cursor polymeric fibers, tows, yarns, or films; a cooling means 835 for active cooling of such irradiated pre-cursor polymeric materials; and a heating means 837 to achieve stabilization of the pre-cursor polymeric materials.

In an embodiment, the irradiating means 833 may comprise a means to provide microwave irradiation. In another embodiment, the irradiating means 833 may comprise a means to provide ultraviolet light irradiation. Such irradiation and stabilization will occur according to various embodiments of the invention method described herein.

An aspect of an embodiment of the system is configured to irradiate the pre-cursor polymeric fibers, tows, yarns, or films with specified duration exposure to radiation; and heat the irradiated precursor polymeric fibers, tows, yarns, or films to achieve stabilization thereof. Another embodiment of this system is configured to apply a specified number of additional doses of irradiation to the irradiated pre-cursor fibers, tows, yarns, or films, each additional dose having a specified duration. An embodiment of the irradiating means can be configured to provide microwaves with frequencies in the range of about 300 GHz to about 300 MHz. In an embodiment, the irradiating means is configured to provide microwaves with a frequency of about 2.45 GHz. Another embodiment of the irradiating means can be configured to provide ultraviolet light with wavelengths in the range of about 10 nm to 405 nm. In an embodiment, the irradiating means can be configured to provide ultraviolet light with a wavelength of about 405 nm.

An aspect of an embodiment of the present invention system provides a cooling means to actively cool the irradiated pre-cursor polymeric fibers, tows, yarns, or films according to above described embodiments of the method. Notably, as depicted schematically in FIG. 8, once the irradiated pre-cursor polymeric fibers, tows yarns, or films are irradiated, said pre-cursor polymeric fibers, tows, yarns, or films can also be passively cooled (as shown at 839) wherein the cooling means of 835 is not used. Instead, in such an embodiment of the system, the pre-cursor polymeric fibers, tows, yarns or films, may be irradiated 833, then cooled passively 839, and then may proceed to treatment via the heating means 837. An aspect of such an embodiment providing passive cooling may be configured to cool the pre-cursor polymeric fibers, tows, yarns, or films by exposing them to the surrounding air. An embodiment of the cooling means may be configured to cool the pre-cursor polymeric fibers, tows, yarns, or films by convection of ambient or chilled air. A further embodiment of the cooling means may be configured to cool the pre-cursor polymeric fibers, tows, yarns, or films by washing them in a liquid bath.

It should also be appreciated that an embodiment of the system may be configured to cool the pre-cursor polymeric fibers, tows, yarns, of films following each of any repetitions of irradiation. Such an embodiment could be configured to allow either passive cooling or active cooling as described by various other embodiments of the system as disclosed herein. In an embodiment, both the active and passive cooling may be employed.

An aspect of an embodiment of the present invention system provides a heating means configured to heat within the following range: about 150° C. to about 300° C. FIG. 8 schematically depicts such an embodiment, wherein the heating means 837 is employed after active cooling 835 of the irradiated precursor polymeric fibers, tows, yarns, or films to stabilize the irradiated pre-cursor materials. Notably, as further depicted in FIG. 8, the heating means 837 may be employed directly following passive cooling 839 of the pre-cursor polymeric fibers, tows, yarns, or films to achieve stabilization of the irradiated pre-cursor materials. An embodiment of the heating means may be configured to provide stabilization over a duration of about 15 hours to about 25 hours. Another embodiment of the heating means may be configured to provide stabilization over a duration of about 10 hours to about 15 hours. Yet another embodiment of the heating means may be configured to provide stabilization over a duration of about 5 hours to about 10 hours. Exemplary benefits of cost-reduction for production of stabilized fibers may be provided by an embodiment of the system, wherein the heating means is configured to provide stabilization over a duration of about 2 hours to about 5 hours. Such exemplary benefits may also be provided by an embodiment of the system, wherein the heating means is configured to provide stabilization over the duration of about 1 hour to about 2 hours.

Another embodiment of the present invention system may be configured such that the heating means provides at least one or more additional heating occurrences to achieve a secondary thermochemical process to the stabilized pre-cursor polymeric fibers, tows, yarns, or films. In an embodiment, the secondary thermochemical process may comprise carbonization. In another embodiment, the secondary thermochemical process may comprise microwave-assisted plasma carbonization. An aspect of an embodiment provides carbonization of the irradiated, stabilized pre-cursor polymeric fibers, tows, yarns, or films, wherein said carbonization is achieved by configuring the heating means to apply additional heat at a range rate in the range of about 0.5° C. to about 25° C. per minute to a final temperature in the ranges of about 1000° C. to about 1700° C. or of about 500° C. to about 3000° C. An embodiment of the system 831 as depicted in FIG. 8 may be configured such that the heating means 837 provides the aforementioned at least one of more additional heating occurrences to achieve a secondary thermochemical process to the stabilized pre-cursor polymeric fibers, tows, yarns, or films.

It should also be appreciated that an embodiment of the invention system can be configured to apply irradiation to a continuous line of pre-cursor fiber, tow, yarn, or film. As a result, an embodiment of the invention system described may be configured for large-scale industrial use, or for small-scale use in laboratories.

Pre-Cursor Production (Spinning)

Additionally, it should be appreciated that any of the embodiments of pre-cursor polymeric fibers, tows, yarns, or films presented in this disclosure, or any variations thereof, may be produced by techniques including but not limited to: melt-spinning, wet-spinning, or other spinning techniques. Example embodiments of pre-cursor production are discussed below in Example and Experimental Results Sets No. 1 and No. 2. Variations of parameters including temperature and extrusion diameter for spinning of the pre-cursor polymeric fibers, tows, yarns, or films are considered embodiments of the present invention, as such parameters can be adjusted for different compositions and uses of pre-cursor polymeric fibers, tows, yarns, or films to be employed in the context of the various embodiments of the present invention disclosed herein.

EXAMPLES

Practice of an aspect of an embodiment (or embodiments) of the invention will be still more fully understood from the following examples and experimental results, which are presented herein for illustration only and should not be construed as limiting the invention in any way.

Example and Experimental Results Set No. 1

Faster Stabilization of Nylon 6/Graphene Composite Fiber Using Microwave Irradiation Nylon 6 pellets (Sigma-Aldrich) were coated in graphene nanoparticles and melt-spun at 250° C. into fibers from a 200 μm nozzle. The precursor fibers were then soaked in a 1 wt % aqueous copper-chloride solution at 95° C. for 2 hours. Following the soaking process, the fibers were allowed to cool naturally in ambient air, washed with deionized water, and dried. The fibers were then exposed to 2.45 GHz microwaves at 700 W in a microwave device (EM720CWA-PMB, Rival) in a stepwise fashion. The initial treatment duration was 60 seconds, which was followed by a 2-minute exposure, 3-minute exposure, and 4-minute exposure in series. The irradiated fibers were then stabilized at 205° C. for 5 hours and subsequently carbonized with a temperature ramp rate of 5° C./min to 1000° C. for 30 min. The resultant fibers had a diameter of 10 μm and exhibited a yield strength of 2.06 GPa, elastic modulus of 176 GPa, and strain of 1.17%.

Example and Experimental Results Set No. 2

Faster Stabilization of Neat Nylon Fiber Using Microwave Irradiation

Nylon 6 pellets (BASF) were melt spun into fibers with an average diameter of 25 μm from a 288-hole spinnerette with outlets of 350 μm diameter. A single tow of these fibers was immersed in a 5 wt % aqueous $FeCl_3$ solution at 95° C. for 2 hours. After 2 hours elapsed, the bath with immersed fibers was irradiated with 2.45 GHz microwaves at 700 W in a microwave device (EM720CWA-PMB, Rival) for 10 minutes. The fibers were then allowed to cool naturally in ambient air, washed with deionized water, and dried. The irradiated fibers were stabilized at 200° C. for 5 hours and subsequently carbonized with a temperature ramp rate of 5° C./min to 1000° C. for 30 min. The resultant carbon fibers had an average diameter of 14 μm and exhibited a yield strength of 2.3 GPa, elastic modulus of 138 GPa, and strain at break of 1.7%.

Example and Experimental Result Set No. 3

In an embodiment, the method and system may be practiced for reducing the stabilization time for polymeric fibers. The method may include: irradiating polymeric fibers with short duration exposure to microwaves; allowing the fibers to cool; and applying a multiple additional doses of microwave and/or irradiation to the already irradiated fibers. In an embodiment, the polymeric fibers may or may not include additives or interstitial components comprising a composite polymeric fiber. In an embodiment, the treated fibers have a diameter in the range of about 5 μm to about 250 μm.

Further, in an embodiment, the initial microwave irradiation duration is in a range of about 5 sec to about 60 sec. In another embodiment, additional doses of microwave or ultraviolet irradiation may or may not be applied and their duration is in a range of about 0 minutes to about 120 minutes. In an approach, fiber irradiation is applied to a continuous line of precursor fiber such as a production line or off-line in batch application format. In an embodiment, the irradiation power applied is between about 100 W and about 1000 W. An aspect of an embodiment may include an article of manufacture produced by any embodiment of the method or system as described herein.

ADDITIONAL EXAMPLES

Example 1. A method for treating pre-cursor polymeric fibers, tows, yarns, or films, said method comprising:

irradiating the pre-cursor polymeric fibers, tows, yarns, or films with specified duration exposure to microwaves and/or ultraviolet light; and cooling the irradiated pre-cursor polymeric fibers, tows, yarns, or films.

Example 2. The method of example 1, further comprising:

irradiating the irradiated pre-cursor polymeric fibers, tows, yarns, or films with specified duration exposure to microwaves and/or ultraviolet light; and cooling the irradiated pre-cursor polymeric fibers, tows, yarns, or films.

Example 3. The method of example 1 (as well as subject matter in whole or in part of example 2), further comprising heating the cooled irradiated pre-cursor polymeric fibers, tows, yarns, or films to achieve stabilization of said pre-cursor polymeric fibers, tows, yarns, or films.

Example 4. The method of example 3 (as well as subject matter in whole or in part of example 2), wherein the heating occurs at a temperature within one of the following ranges:

about 150° C. to about 300° C.;

about 200° C. to about 250° C.;

about 250° C. to about 300° C.; or about 200° C. to about 215° C.

Example 5. The method of example 3 (as well as subject matter of one or more of any combination of examples 2 or 4, in whole or in part), wherein the stabilization is provided over a duration of one of the following ranges:

about 15 hours to about 25 hours;

about 10 hours to about 15 hours;

about 5 hours to about 10 hours;

about 2 hours to about 5 hours; or about 1 hour to about 2 hours.

Example 6. The method of example 4 (as well as subject matter of one or more of any combination of examples 2-3 and 5, in whole or in part), further comprising at least one or more additional heating occurrences to achieve a secondary thermochemical process to said pre-cursor polymeric fibers, tows, yarns, or films.

Example 7. The method of example 6 (as well as subject matter of one or more of any combination of examples 2-5, in whole or in part), wherein said secondary thermochemical process may comprise: thermal carbonization or microwave-assisted plasma carbonization of said pre-cursor polymeric fibers, tows, yarns, or films.

Example 8. The method of example 7, (as well as subject matter of one or more of any combination of examples 2-6, in whole or in part) wherein said additional heating includes increasing the heat at a ramp rate in the range of about 0.5° C. to about 25° C. per minute to a final temperature in the ranges of about 1000° C. to about 1700° C. or of about 500° C. to about 3000° C. to achieve the carbonization of said pre-cursor polymeric fibers, tows, yarns, or films.

Example 9. The method of example 8 (as well as subject matter of one or more of any combination of examples 2-7, in whole or in part), wherein the carbonization occurs over a duration of one of the following:

a range of about 15 minutes to about 3 hours;

a range of about 1 hour to about 2 hours;

a range of about 30 minutes to about 60 minutes; or about 30 minutes.

Example 10. The method of example 1 (as well as subject matter of one or more of any combination of examples 2-9, in whole or in part), wherein the specified duration of the irradiation has the duration of one of the following ranges:

about 5 seconds to about 60 seconds;

about 60 seconds to about 10 minutes;

about 10 minutes to about 20 minutes;

about 20 minutes to about 30 minutes;

about 30 minutes to about 45 minutes; or about 45 minutes to about 60 minutes.

Example 11. The method of example 2 (as well as subject matter of one or more of any combination of examples 2-10, in whole or in part), wherein said specified duration of the irradiation of example 2 is a longer duration, shorter duration, or equal duration as that of the duration of the irradiation in example 1.

Example 12. The method of example 2 (as well as subject matter of one or more of any combination of examples 2-11, in whole or in part), wherein said specified duration of the irradiation of example 2 is of one of the following ranges:

about 5 seconds to about 120 minutes;

about 5 seconds to about 60 seconds;

about 60 seconds to about 10 minutes;

about 10 minutes to about 20 minutes;

about 20 minutes to about 30 minutes;

about 30 minutes to about 45 minutes;

about 45 minutes to about 60 minutes; or about 60 minutes to about 120 minutes.

Example 13. The method of example 2 (as well as subject matter of one or more of any combination of examples 2-12, in whole or in part), wherein said irradiating and cooling of example 2 are repeated a specified number of times of one of the following ranges:

between 5 and 10 times; or between 1 and 4 times.

Example 14. The method of example 13 (as well as subject matter of one or more of any combination of examples 2-12, in whole or in part), wherein said duration of the irradiation is sequentially longer.

Example 15. The method of any of examples 1, 2, or 13 (as well as subject matter of one or more of any combination of examples 3-12 or 14, in whole or in part), wherein the irradiation of examples 1, 2, or 13, respectively, is applied at one of the following:

a power of a range between about 100 W and about 100 kW;

a power of a range between about 100 W and about 1000 W; or a power of about 700 W.

Example 16. The method of example 13 (as well as subject matter of one or more of any combination of examples 2-12 and 14-15, in whole or in part), further comprising heating the cooled irradiated pre-cursor polymeric fibers, tows, yarns, or films to achieve pre-cursor stabilization of said polymeric fibers, tows, yarns, or films.

Example 17. The method of example 13 (as well as subject matter of one or more of any combination of examples 2-12 and 14-16, in whole or in part), wherein the heating occurs at a temperature within one of the following ranges:

about 150° C. to about 300° C.;
about 200° C. to about 250° C.;
about 250° C. to about 300° C.; or
about 200° C. to about 215° C.

Example 18. The method of example 16 (as well as subject matter of one or more of any combination of examples 2-15 and 17, in whole or in part), wherein the stabilization is provided over a duration of one of the following ranges:

about 15 hours to about 25 hours;
about 10 hours to about 15 hours;
about 5 hours to about 10 hours;
about 2 hours to about 5 hours; or
about 1 hour to about 2 hours.

Example 19. The method of example 16 (as well as subject matter of one or more of any combination of examples 2-15 and 17-18, in whole or in part), further comprising at least one or more additional heating occurrences to achieve a secondary thermochemical process to said pre-cursor polymeric fibers, tows, yarns, or films.

Example 20. The method of example 19 (as well as subject matter of one or more of any combination of examples 2-18, in whole or in part), wherein said secondary thermochemical process may comprise: carbonization or microwave-assisted plasma carbonization of said pre-cursor polymeric fibers, tows, yarns, or films.

Example 21. The method of example 20 (as well as subject matter of one or more of any combination of examples 2-19, in whole or in part), wherein said additional heating includes increasing the heat at a ramp rate in the range of about 0.5° C. to about 25° C. per minute to a final temperature in the ranges of about 1000° C. to about 1700° C. or of about 500° C. to about 3000° C. to achieve the carbonization of said pre-cursor polymeric fibers, tows, yarns, or films.

Example 22. The method of example 21 (as well as subject matter of one or more of any combination of examples 2-20, in whole or in part), wherein the carbonization occurs over a duration of one of the following:

a range of about 15 minutes to about 3 hours;
a range of about 1 hour to about 2 hours;
a range of about 30 minutes to about 60 minutes; or
about 30 minutes.

Example 23. The method of example 1 (as well as subject matter of one or more of any combination of examples 2-22, in whole or in part), wherein said exposure to microwaves comprises exposure to microwave frequencies in the range of about 300 GHz to about 300 MHz.

Example 24. The method of example 23 (as well as subject matter of one or more of any combination of examples 2-22, in whole or in part), wherein said exposure to microwaves comprises exposure to microwave frequency of about 2.45 GHz.

Example 25. The method of example 1 (as well as subject matter of one or more of any combination of examples 2-24, in whole or in part), wherein said exposure to ultraviolet light comprises exposure to ultraviolet light wavelengths in the range of about 10 nm to about 450 nm.

Example 26. The method of example 25 (as well as subject matter of one or more of any combination of examples 2-24, in whole or in part), wherein said exposure to ultraviolet light comprises exposure to ultraviolet light wavelength of about 405 nm.

Example 27. The method of example 1 (as well as subject matter of one or more of any combination of examples 2-26, in whole or in part), wherein said pre-cursor polymeric fiber, tow, yarn, or film is a multi-component polymer composite comprised of a polymeric fiber, tow, yarn, or film and at least one or more constituent materials.

Example 28. The method of example 27 (as well as subject matter of one or more of any combination of examples 2-26, in whole or in part), wherein said at least one or more constituent materials defines a constituent content having a concentration comprising a range of one of the following:

about 0.01% to about 1%; or
about 0.05% to about 0.1%,
of the multi-component polymer composite.

Example 29. The method of example 28 (as well as subject matter of one or more of any combination of examples 2-27, in whole or in part), wherein said at least one or more constituent materials may comprise the following: graphene, borophene, boron carbide, carbon nanotubes, or other nanomaterials.

Example 30. The method of example 27 (as well as subject matter of one or more of any combination of examples 2-26 and 28-29, in whole or in part), wherein the polymeric fiber, tow, yarn, or film comprises polyamide, polyethylene, high-density polyethylene (HDPE), ultra-high molecular weight polyethylene (UHMWPE), other bio-sourced polymer, or a non-PAN-based polymer.

Example 31. The method of example 27 (as well as subject matter of one or more of any combination of examples 2-26 and 28-30, in whole or in part), wherein the polymeric fiber, tow, yarn, or film comprises polyamide.

Example 32. The method of example 31 (as well as subject matter of one or more of any combination of examples 2-30, in whole or in part), wherein the at least one or more constituent materials comprise graphene.

Example 33. The method of example 31 (as well as subject matter of one or more of any combination of examples 2-30 and 32, in whole or in part), wherein the at least one or more constituent materials may further comprise one of the following metallic compounds: CuCl, $CuCl_2$, or $FeCl_3$.

Example 34. The method of any one of examples 1, 2, or 13 (as well as subject matter of one or more of any combination of examples 3-12, 14-15 and 17-33, in whole or in part), wherein the treated pre-cursor polymeric fibers, tows, yarns, or films have a diameter in the range of about 5 μm to about 250 μm.

Example 35. A carbonized graphene-polymer hybrid fiber, tow, yarn, or film composite, comprising:

a carbonized graphene-polymer hybrid fiber, tow, yarn, or film composed of carbonized pre-cursor polymeric fibers, tows, yarns, or films; and graphene.

Example 36. The carbonized graphene-polymer hybrid fiber, tow, yarn, or film composite of example 35, wherein the graphene is in the form of graphene sheets.

Example 37. The carbonized graphene-polymer hybrid fiber, tow, yarn, or film composite of example 36, wherein the graphene sheets are present on the interior and exterior of the composite.

Example 38. The carbonized graphene-polymer hybrid fiber, tow, yarn, or film composite of example 36 (as well as subject matter in whole or in part of example 37), wherein the graphene is present in an amount ranging from one of the following:

about 0.01% to about 1%; or about 0.05% to about 0.1%, by weight based on total weight of the composite.

Example 39. The carbonized graphene-polymer hybrid fiber, tow, yarn, or film composite of example 35 (as well as subject matter of one or more of any combination of examples 36-38, in whole or in part), wherein said pre-cursor polymeric fibers, tows, yarns, or films comprise polyamide, polyethylene, high-density polyethylene (HDPE), ultra-high molecular weight polyethylene (UHMWPE), other bio-sourced polymer, or a non-PAN-based polymer.

Example 40. The carbonized graphene-polymer hybrid fiber composite of example 35 (as well as subject matter of one or more of any combination of examples 36-39, in whole or in part), wherein said pre-cursor polymeric fibers, tows, yarns, or films are polyamide.

Example 41. The carbonized graphene-polymer hybrid fiber, tow, yarn, or film composite of example 35 (as well as subject matter of one or more of any combination of examples 36-40, in whole or in part), wherein said pre-cursor polymeric fibers, tows, yarns, or films are polyethylene.

Example 42. The carbonized graphene-polymer hybrid fiber, tow, yarn, or film composite of example 35 (as well as subject matter of one or more of any combination of examples 36-41, in whole or in part), wherein the carbonized graphene-polymer hybrid fiber, tow, yarn, or film has the following properties:

a strength in the range of one of the following:

about 1.00 GPa to about 3.50 GPa; or about 1.86 GPa to about 2.06 GPa, an elastic modulus in the range of one of the following:

about 100 GPa to about 350 GPa; or about 176 GPa to about 192 GPa, and a strain in the range of one of the following:

about 0.6% to about 2.5%; or about 1.05% to about 1.17%.

Example 43. A pre-cursor polymeric fiber, tow, yarn, or film that is a multi-component polymer composite comprised of a polymeric fiber, tow, yarn, or film and at least one or more constituent materials, wherein said fiber, tow, yarn, or film is irradiated and stabilized.

Example 44. The pre-cursor polymeric fiber, tow, yarn, or film of example 43, wherein said at least one or more constituent materials defines a constituent content having a concentration comprising a range of about 0.01% to about 1% of the multi-component polymer composite.

Example 45. The pre-cursor polymeric fiber, tow, yarn, or film of example 44 (as well as subject matter in whole or in part of example 44), wherein said at least one or more constituent materials may comprise the following: graphene, borophene, boron carbide, carbon nanotubes, or other nanomaterials.

Example 46. The pre-cursor polymeric fiber, tow, yarn, or film of example 43 (as well as subject matter of one or more of any combination of examples 44-45, in whole or in part), wherein the polymeric fiber, tow, yarn, or film comprises polyamide, polyethylene, high-density polyethylene (HDPE), ultra-high molecular weight polyethylene (UHMWPE), other bio-sourced polymer, or a non-PAN-based polymer.

Example 47. The pre-cursor polymeric fiber, tow, yarn, or film of example 43 (as well as subject matter of one or more of any combination of examples 44-46, in whole or in part), wherein the polymeric fiber, tow, yarn, or film comprises polyamide.

Example 48. The pre-cursor polymeric fiber, tow, yarn, or film of example 47 (as well as subject matter of one or more of any combination of examples 44-47, in whole or in part), wherein the at least one or more constituent materials comprise graphene.

Example 49. The pre-cursor polymeric fiber, tow, yarn, or film of example 47 (as well as subject matter of one or more of any combination of examples 44-46 and 48, in whole or in part), wherein the at least one or more constituent materials may further comprise one of the following metallic compounds: CuCl, $CuCl_2$, or $FeCl_3$.

Example 50 (as well as subject matter of one or more of any combination of examples 44-49, in whole or in part). The pre-cursor polymeric fiber, tow, yarn, or film of example 43, where said pre-cursor polymeric fiber, tow, yarn, or film is carbonized.

Example 51. The carbonized pre-cursor polymeric fiber, tow, yarn, or film composite of example 50 (as well as subject matter of one or more of any combination of examples 44-49, in whole or in part), wherein said carbonized pre-cursor polymeric fiber has the following properties:

a strength in the range of one of the following:

about 1.00 GPa to about 3.50 GPa; or about 1.86 GPa to about 2.06 GPa, an elastic modulus in the range of one of the following:

about 100 GPa to about 350 GPa; or about 176 GPa to about 192 GPa, and a strain in the range of one of the following:

about 0.6% to about 2.5%; or about 1.05% to about 1.17%.

Example 52. A system for treating pre-cursor polymeric fibers, tows, yarns, or films, said system comprising:

an irradiating means for irradiating the pre-cursor polymeric fibers, tows, yarns, or films with specified duration exposure; and a heating means for heating the irradiated pre-cursor polymeric fibers, tows, yarns, or films to achieve stabilization of said pre-cursor polymeric fibers, tows, yarns, or films.

Example 53. The system of example 52, wherein said irradiating means is further configured to apply a specified number of additional doses of irradiation to the irradiated pre-cursor polymeric fibers, tows, yarns, or films, said additional doses of irradiation having a specified duration.

Example 54. The system of example 52 (as well as subject matter in whole or in part of example 53), wherein said irradiation means is configured to apply the irradiation to a continuous line of precursor fiber, tow, yarn, or film, such as a production line or off-line in batch application format.

Example 55. The system of example 52 (as well as subject matter of one or more of any combination of examples 53-54, in whole or in part), wherein said irradiating means is configured to provide microwaves with frequencies in the range of about 300 GHz to about 300 MHz.

Example 56. The system of example 55 (as well as subject matter of one or more of any combination of examples 53-54, in whole or in part), wherein said irradiating means is configured to provide microwaves with a frequency of about 2.45 GHz.

Example 57. The system of example 52 (as well as subject matter of one or more of any combination of examples 53-56, in whole or in part), wherein said irradiating means is configured to provide ultraviolet light with wavelengths in the range of about 10 nm to about 450 nm.

Example 58. The system of example 57 (as well as subject matter of one or more of any combination of examples 53-56, in whole or in part), wherein said irradiating means is configured to provide ultraviolet light with a wavelength of about 405 nm.

Example 59. The system of example 52 (as well as subject matter of one or more of any combination of examples 53-58, in whole or in part), further comprising a cooling means for cooling the irradiated pre-cursor polymeric fibers, tows, yarns, or films.

Example 60. The system of example 59 (as well as subject matter of one or more of any combination of examples 53-58, in whole or in part), wherein said cooling means is further configured to perform one of the following:

cooling the pre-cursor polymeric fibers, tows, yarns, or films by convection of ambient or chilled air;

cooling the pre-cursor polymeric fibers, tows, yarns, or films by exposure to the surrounding air; or cooling the pre-cursor polymeric fibers, tows, yarns, or films by washing them in a liquid bath.

Example 61. The system of example 53 (as well as subject matter of one or more of any combination of examples 54-60, in whole or in part), further comprising a cooling means for cooling the irradiated pre-cursor polymeric fibers, tows, yarns, or films following each of one or more additional doses of irradiation.

Example 62. The system of example 61 (as well as subject matter of one or more of any combination of examples 53-60, in whole or in part), wherein said cooling means is further configured to perform one of the following:

cooling the pre-cursor polymeric fibers, tows, yarns, or films by convection of ambient or chilled air;

cooling the pre-cursor polymeric fibers, tows, yarns, or films by exposure to the surrounding air; or cooling the pre-cursor polymeric fibers, tows, yarns, or films by washing them in a liquid bath.

Example 63. The system of example 52 or 53 (as well as subject matter of one or more of any combination of examples 54-62, in whole or in part), wherein the heating means is configured to heat within the following range: about 150° C. to about 300° C.

Example 64. The system of example 63 (as well as subject matter of one or more of any combination of examples 53-62, in whole or in part), wherein the heating means is further configured to provide stabilization over a duration of one of the following ranges:

about 15 hours to about 25 hours;

about 10 hours to about 15 hours;

about 5 hours to about 10 hours;

about 2 hours to about 5 hours; or about 1 hour to about 2 hours.

Example 65. The system of example 52 or 53 (as well as subject matter of one or more of any combination of examples 54-64, in whole or in part), wherein the heating means is further configured to provide at least one or more additional heating occurrences to achieve a secondary thermochemical process to said pre-cursor polymeric fibers, tows, yarns, or films.

Example 66. The system of example 65 (as well as subject matter of one or more of any combination of examples 53-64, in whole or in part), wherein said secondary thermochemical process may comprise: carbonization or microwave-assisted plasma carbonization of said pre-cursor polymeric fibers, tows, yarns, or films.

Example 67. The system of example 65 (as well as subject matter of one or more of any combination of examples 53-64 and 66, in whole or in part), wherein the heating means is further configured to include increasing the heat at a ramp rate in the range of about 0.5° C. to about 25° C. per minute to a final temperature in the ranges of about 1000° C. to about 1700° C. or of about 500° C. to about 3000° C. to achieve a secondary thermochemical process to said pre-cursor polymeric fibers, tows, yarns, or films.

Example 68. The method of example 1, (as well as subject matter of one or more of any combination of examples 2-34, in whole or in part) wherein the pre-cursor polymeric fiber, tow, yarn, or film is already spun or otherwise prepared prior to the irradiation.

Example 69. The pre-cursor polymeric fiber, tow, yarn, or film of example 43, (as well as subject matter of one or more of any combination of examples 44-51, in whole or in part) wherein the pre-cursor polymeric fiber, tow, yarn, or film is already spun or otherwise prepared prior to the irradiation.

Example 70. The system of example 52, (as well as subject matter of one or more of any combination of examples 53-67, in whole or in part) wherein the pre-cursor polymeric fiber, tow, yarn, or film is already spun or otherwise prepared prior to the irradiation.

Example 71. A method of manufacturing any one or more of the composites in any one or more of Examples 35-51.

Example 72. A method of using any one or more of the composites in industry in any one or more of Examples 35-51.

Example 73. An article of manufacture produced by any one or more of the methods in any one or more of Examples 1-34.

Example 74. A system in any one or more of Examples 52-67 applying the methods in any one or more of Examples 1-34.

Example 75. An article of manufacture produced by any one or more of the systems in any one or more of Examples 52-67.

REFERENCES

The devices, article of manufacture, materials, compositions, systems, apparatuses, compositions, materials, machine readable medium, computer readable medium, computer program products, and methods of various embodiments of the invention disclosed herein may utilize aspects (such as devices, article of manufacture, materials, compositions, systems, apparatuses, compositions, materials, machine readable medium, computer readable medium, computer program products, and methods) disclosed in the following references, applications, publications and patents and which are hereby incorporated by reference herein in their entirety, and which are not admitted to be prior art with respect to the present invention by inclusion in this section:

1. Gao Z, et al. "Graphene Reinforced Carbon Fibers", Science Advances. 2020. 6 (7): eaaz4191.
2. U.S. Pat. No. 10,446,329 B2, Li, et al., "Process of Forming Electrodes and Products Thereof from Biomass", Oct. 15, 2019.
3. U.S. Patent Application Publication No. US 2017/0084924 A1, "Process of Forming Electrodes and Products Thereof from Biomass", Mar. 23, 2017.
4. U.S. Patent Application Publication No. US 2018/0244582 A1, Li, et al., "Method of Forming Graphene/Metal-Oxide Hybrid Reinforced Composites and Product Thereof", Aug. 30, 2018.
5. International Patent Application Publication No. WO 2017/031403 A1, Li, et al., "Method of Forming Graphene/Metal-Oxide Hybrid Reinforced Composites and Product Thereof", Feb. 23, 2017.
6. Korean Patent No. KR 101327972 B1, Jeun, et al., "Preparing Method of Stabilized Carbon Nano-Fiber by Radiation and Thermal Treatment, and the Carbon Nano-Fiber Prepared by the Same Method", Nov. 13, 2013.
7. Korean Patent Application Publication No. KR 2011/0115332 A, Jeun, et al., "Preparation Method of Carbon Fiber by Radiation and Thermal Stabilization", Oct. 21, 2011.
8. U.S. Pat. No. 10,344,404 B2, Jo, et al., "Nanocarbon Composite Carbon Fiber with Low Cost and High Performance and Their Preparation Method", Jul. 9, 2019.
9. U.S. Pat. No. 7,381,752 B2, Muratoglu, "Selective Controlled Manipulation of Polymers", Jun. 3, 2008.
10. U.S. Pat. No. 7,786,253 B2, Paulauskas, et al., "Apparatus and Method for Oxidation and Stabilization of Polymeric Materials", Aug. 31, 2010.
11. U.S. Pat. No. 7,649,078 B1, Paulauskas, et al.,"Apparatus and Method for Stabilization or Oxidation of Polymeric Materials", Jan. 19, 2010.
12. U.S. Pat. No. 5,160,464, Ward, et al., "Polymer Irradiation", Nov. 3, 1992.
13. Platzer. "Stabilization of Polymers and Stabilizer Processes", Advances in Chemistry. 1968. vii-xvii.
14. Shin H K, et al. "An Overview of New Oxidation Methods for Polyacrylonitrile-Based Carbon Fibers", Carbon Letters. 2015. 16 (1): 11-18.
15. U.S. Pat. No. 8,685,361, Yang, et al., "Method for Preparing Polyacrylonitrile-Based Polymer for Preparation of Carbon Fiber Using Microwave and Method for Preparing Carbin Fiber Using the Same", Apr. 1, 2014.
16. U.S. Pat. No. 4,197,282, Bailly-Lacresse, et al., "Manufacture of carbon fibres", Apr. 8, 1980.
17. International Patent Application Publication No. WO 2019/071286 A1, Atkiss, S. et al., "Precursor Stabilisation Process", Apr. 18, 2019.
18. Kim S Y, et al., "Microwave Plasma Carbonization for the Fabrication of Polyacrylonitrile-Based Carbon Fiber". Polymer. Jan. 15, 2015. 56: 590-595.
19. Lee S W, et al., "Efficient Preparation of Carbon Fibers Using Plasma Assisted Stabilization", Carbon. 2013. 55:361-371.
20. Yuan H W, et al., "Effect of UV Irradiation on PAN Precursor Fibers and Stabilization Process". Journal of Wuhan University of Technology-Mater, Sci. Ed. June 2011. 449-454.
21. Dang W, et al., "Effects of y-Ray Irradiation on the Radial Structure Hetereogeneity in Polyacrylonitrile Fibers during Thermal Stabilization". Polymers. 2018. 10:943-951.

In summary, while the present invention has been described with respect to specific embodiments, many modifications, variations, alterations, substitutions, and equivalents will be apparent to those skilled in the art. The present invention is not to be limited in scope by the specific embodiment described herein. Indeed, various modifications of the present invention, in addition to those described herein, will be apparent to those of skill in the art from the foregoing description and accompanying drawings. Accordingly, the invention is to be considered as limited only by the spirit and scope of the disclosure, including all modifications and equivalents.

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, there is no requirement for the inclusion in any claim herein or of any application claiming priority hereto of any particular described or illustrated activity or element, any particular sequence of such activities, or any particular interrelationship of such elements. Moreover, any activity can be repeated, any activity can be performed by multiple entities, and/or any element can be duplicated. Further, any activity or element can be excluded, the sequence of activities can vary, and/or the interrelationship of elements can vary. Unless clearly specified to the contrary, there is no requirement for any particular described or illustrated activity or element, any particular sequence or such activities, any particular size, speed, material, dimension or frequency, or any particularly interrelationship of such elements. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all sub ranges therein. Any information in any material (e.g., a United States/foreign patent, United States/foreign patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

What is claimed is:

1. A method for treating pre-cursor polymeric fibers, tows, yarns, or films, said method comprising:

irradiating the pre-cursor polymeric fibers, tows, yarns, or films with specified duration exposure to microwaves and/or ultraviolet light;

cooling the irradiated pre-cursor polymeric fibers, tows, yarns, or films;

wherein said pre-cursor polymeric fiber, tow, yarn, or film is a multi-component polymer composite comprised of a polymeric fiber, tow, yarn, or film and at least one or more constituent materials;

wherein the polymeric fiber, tow, yarn, or film comprises polyamide; and wherein the at least one or more constituent materials comprises one of the following metallic compounds: CuCl, $CuCl_2$, or $FeCl_3$.

2. The method of claim 1, wherein the specified duration of the irradiation has the duration of one of the following ranges:

about 5 seconds to about 60 seconds;
about 60 seconds to about 10 minutes;
about 10 minutes to about 20 minutes;
about 20 minutes to about 30 minutes;
about 30 minutes to about 45 minutes; or
about 45 minutes to about 60 minutes.

3. The method of claim 1, wherein the irradiation of claim 1, is applied at one of the following:

a power of a range between about 100W and about 100 kW;

a power of a range between about 100W and about 1000W; or a power of about 700W.

4. The method of claim 1, wherein said exposure to microwaves comprises exposure to microwave frequencies in the range of about 300 GHz to about 300 MHz.

5. The method of claim 1, wherein said exposure to microwaves comprises exposure to microwave frequency of about 2.45 GHz.

6. The method of claim 1, wherein the polymeric fiber, tow, yarn, or film comprises polyamide, polyethylene, high-density polyethylene (HDPE), ultra-high molecular weight polyethylene (UHMWPE), other bio-sourced polymer, or a non-PAN-based polymer.

7. The method of claim 1, wherein the at least one or more constituent materials comprise graphene.

8. The method of claim 1, wherein the treated pre-cursor polymeric fibers, tows, yarns, or films have a diameter in the range of about 5 μm to about 250 μm.

9. The method of claim 1, wherein the pre-cursor polymeric fiber, tow, yarn, or film is already spun or otherwise prepared prior to the irradiation.

10. The method of claim 1, wherein said exposure to ultraviolet light comprises exposure to ultraviolet light wavelengths in the range of about 10 nm to about 450 nm.

11. The method of claim 10, wherein said exposure to ultraviolet light comprises exposure to ultraviolet light wavelength of about 405 nm.

12. The method of claim 1, wherein said at least one or more constituent materials defines a constituent content having a concentration comprising a range of one of the following:

about 0.01% to about 1%; or
about 0.05% to about 0.1%,
of the multi-component polymer composite.

13. The method of claim 12, wherein said at least one or more constituent materials comprises the following: graphene, borophene, boron carbide, carbon nanotubes, or other nanomaterials.

14. The method of claim 1, further comprising heating the cooled irradiated pre-cursor polymeric fibers, tows, yarns, or films to achieve stabilization of said pre-cursor polymeric fibers, tows, yarns, or films.

15. The method of claim 14, wherein the stabilization is provided over a duration of one of the following ranges:

about 15 hours to about 25 hours;
about 10 hours to about 15 hours;
about 5 hours to about 10 hours;
about 2 hours to about 5 hours; or
about 1 hour to about 2 hours.

16. The method of claim 14, wherein the heating occurs at a temperature within one of the following ranges:

about 150° C. to about 300° C.;
about 200° C. to about 250° C.;
about 250° C. to about 300° C.; or
about 200° C. to about 215° C.

17. The method of claim 16, further comprising at least one or more additional heating occurrences to achieve a secondary thermochemical process to said pre-cursor polymeric fibers, tows, yarns, or films.

18. The method of claim 17, wherein said secondary thermochemical process may comprise: thermal carbonization or microwave-assisted plasma carbonization of said pre-cursor polymeric fibers, tows, yarns, or films.

19. The method of claim 18, wherein said additional heating includes increasing the heat at a ramp rate in the range of about 0.5° C. to about 25° C. per minute to a final temperature in the ranges of about 1000° C. to about 1700° C. or of about 500° C. to about 3000° C. to achieve the carbonization of said pre-cursor polymeric fibers, tows, yarns, or films.

20. The method of claim 19, wherein the carbonization occurs over a duration of one of the following:

a range of about 15 minutes to about 3 hours;
a range of about 1 hour to about 2 hours;
a range of about 30 minutes to about 60 minutes; or
about 30 minutes.

21. The method of claim 1, further comprising:

irradiating the irradiated pre-cursor polymeric fibers, tows, yarns, or films with specified duration exposure to microwaves and/or ultraviolet light; and cooling the irradiated pre-cursor polymeric fibers, tows, yarns, or films.

22. The method of claim 21, wherein said specified duration of the irradiation of claim 21 is a longer duration, shorter duration, or equal duration as that of the duration of the irradiation in claim 1.

23. The method of claim 21, wherein said specified duration of the irradiation of claim 21 is of one of the following ranges:

about 5 seconds to about 120 minutes;
about 5 seconds to about 60 seconds;
about 60 seconds to about 10 minutes;
about 10 minutes to about 20 minutes;
about 20 minutes to about 30 minutes;
about 30 minutes to about 45 minutes;
about 45 minutes to about 60 minutes; or
about 60 minutes to about 120 minutes.

24. The method of claim 21, wherein the irradiation of claim 2, is applied at one of the following:

a power of a range between about 100W and about 100 kW;

a power of a range between about 100W and about 1000W; or a power of about 700W.

25. The method of claim 21, wherein the treated pre-cursor polymeric fibers, tows, yarns, or films have a diameter in the range of about 5 μm to about 250 μm.

26. The method of claim 21, wherein said irradiating and cooling of claim 21 are repeated a specified number of times of one of the following ranges:

between 5 and 10 times; or between 1 and 4 times.

27. The method of claim 26, wherein said duration of the irradiation is sequentially longer.

28. The method of claim 26, wherein the heating occurs at a temperature within one of the following ranges:

about 150° C. to about 300° C.;

about 200° C. to about 250° C.;

about 250° C. to about 300° C.; or about 200° C. to about 215° C.

29. The method of claim 26, wherein the irradiation of claim 13, is applied at one of the following:

a power of a range between about 100W and about 100 kW;

a power of a range between about 100W and about 1000W; or a power of about 700W.

30. The method of claim 26, wherein the treated pre-cursor polymeric fibers, tows, yarns, or films have a diameter in the range of about 5 μm to about 250 μm.

31. The method of claim 26, further comprising heating the cooled irradiated pre-cursor polymeric fibers, tows, yarns, or films to achieve stabilization of said pre-cursor polymeric fibers, tows, yarns, or films.

32. The method of claim 31, wherein the stabilization is provided over a duration of one of the following ranges:

about 15 hours to about 25 hours;

about 10 hours to about 15 hours;

about 5 hours to about 10 hours;

about 2 hours to about 5 hours; or about 1 hour to about 2 hours.

33. The method of claim 31, further comprising at least one or more additional heating occurrences to achieve a secondary thermochemical process to said pre-cursor polymeric fibers, tows, yarns, or films.

34. The method of claim 33, wherein said secondary thermochemical process may comprise: carbonization or microwave-assisted plasma carbonization of said pre-cursor polymeric fibers, tows, yarns, or films.

35. The method of claim 34, wherein said additional heating includes increasing the heat at a ramp rate in the range of about 0.5° C. to about 25° C. per minute to a final temperature in the ranges of about 1000° C. to about 1700° C. or of about 500° C. to about 3000° C. to achieve the carbonization of said pre-cursor polymeric fibers, tows, yarns, or films.

36. The method of claim 35, wherein the carbonization occurs over a duration of one of the following:

a range of about 15 minutes to about 3 hours;

a range of about 1 hour to about 2 hours;

a range of about 30 minutes to about 60 minutes; or about 30 minutes.

* * * * *